US008307774B2

(12) United States Patent
Matsueda

(10) Patent No.: US 8,307,774 B2
(45) Date of Patent: Nov. 13, 2012

(54) ROWING BOAT FOOTREST ASSEMBLY

(75) Inventor: Keiji Matsueda, Yamaguchi (JP)

(73) Assignee: Shimano Inc., Osaka (JP)

( * ) Notice: Subject to any disclaimer, the term of this patent is extended or adjusted under 35 U.S.C. 154(b) by 296 days.

(21) Appl. No.: 12/821,479

(22) Filed: Jun. 23, 2010

(65) Prior Publication Data

US 2011/0315066 A1 Dec. 29, 2011

(51) Int. Cl.
*B63H 25/00* (2006.01)

(52) U.S. Cl. ..... 114/363; 114/153

(58) Field of Classification Search ..... 114/347, 114/153, 363, 162
See application file for complete search history.

(56) References Cited

U.S. PATENT DOCUMENTS 231,017 A 8/1880 Davis
4,228,756 A * 10/1980 Storer, Jr. ..... 114/144 R
5,367,976 A * 11/1994 Van Schaik ..... 114/347
6,739,277 B2 * 5/2004 Knight ..... 114/347
8,051,794 B2 * 11/2011 Matsueda et al. ..... 114/363
8,069,803 B1 * 12/2011 Crawford ..... 114/172
2009/0205556 A1 8/2009 Kawahara et al.
2009/0241827 A1 10/2009 Matsueda et al.
2010/0018450 A1 1/2010 Matsueda et al.

* cited by examiner

*Primary Examiner* — Stephen Avila
(74) *Attorney, Agent, or Firm* — Global IP Counselors, LLP

(57) ABSTRACT

A rowing boat footrest assembly is provided with a base, a foot-rudder control member, a footrest member and a positioning structure. The foot-rudder control member pivotally coupled to the base. The foot-rudder control member includes a rudder control attachment. The footrest member is supported on the foot-rudder control member. The footrest member includes a shoe attachment. The positioning structure is operatively coupled between the base and the foot-rudder control member. The positioning structure includes a contact member and a setting member. The contact member is movably provided to one of the base and the foot-rudder control member. The contact member is biased into contact with the other of the base and the foot-rudder control member. The setting member is adjustably arranged to change an urging force on the contact member.

14 Claims, 19 Drawing Sheets

ROWING BOAT FOOTREST ASSEMBLY

BACKGROUND

1. Field of the Invention

This invention generally relates to a rowing boat footrest assembly. More specifically, the present invention relates to a rowing boat footrest assembly which includes a rudder control function.

2. Background Information

Traditionally, the footrest in a rowing boat is an angled surface upon which a rower can brace his or her feet to provide increased power during the rowing process. Recently, footrests have been provided with simple shoe retaining straps or mechanisms that hold a rower's shoe against the surface of the footrest. Typically, the footrest cannot move during the rowing back and forth stroke. However, the footrest is often adjustable to accommodate different sizes of rowers. In some instances, the location of the entire footrest is adjustable in the longitudinal direction of the rowing boat. Also, in some cases, the angle of the footrest is adjustable with respect to the rowing boat.

In some cases, rowing boats are provided with a rudder to steer the rowing boat in the water. Since a rower is typically using both hands for rowing, it is difficult for the rower to operate the rudder while rowing. To avoid this problem, it has been proposed to provide a foot operated steering apparatus that allows the rower to control a rudder of the rowing boat while rowing. For example, one proposed foot operated steering apparatus is disclosed in U.S. Pat. No. 231,017,which issued to Michael F. Davis.

In view of the above, it will be apparent to those skilled in the art from this disclosure that there exists a need for an improved rowing boat footrest assembly that includes a rudder control function. This invention addresses this need in the art as well as other needs, which will become apparent to those skilled in the art from this disclosure.

SUMMARY

One aspect is to provide a rowing boat footrest assembly that includes a rudder control function.

In view of the state of the known technology, a rowing boat footrest assembly is proposed that basically comprises a base, a foot-rudder control member, a footrest member and a positioning structure. The foot-rudder control member pivotally coupled to the base. The foot-rudder control member includes a rudder control attachment. The footrest member is supported on the foot-rudder control member. The footrest member includes a shoe attachment. The positioning structure is operatively coupled between the base and the foot-rudder control member. The positioning structure includes a contact member and a setting member. The contact member is movably provided to one of the base and the foot-rudder control member. The contact member is biased into contact with the other of the base and the foot-rudder control member. The setting member is adjustably arranged to change an urging force on the contact member.

These and other objects, features, aspects and advantages of the present invention will become apparent to those skilled in the art from the following detailed description, which, taken in conjunction with the annexed drawings, discloses preferred embodiments.

BRIEF DESCRIPTION OF THE DRAWINGS

Referring now to the attached drawings which form a part of this original disclosure.

DETAILED DESCRIPTION OF EMBODIMENTS

Selected embodiments will now be explained with reference to the drawings. It will be apparent to those skilled in the art from this disclosure that the following descriptions of the embodiments are provided for illustration only and not for the purpose of limiting the invention as defined by the appended claims and their equivalents.

Figure 1:
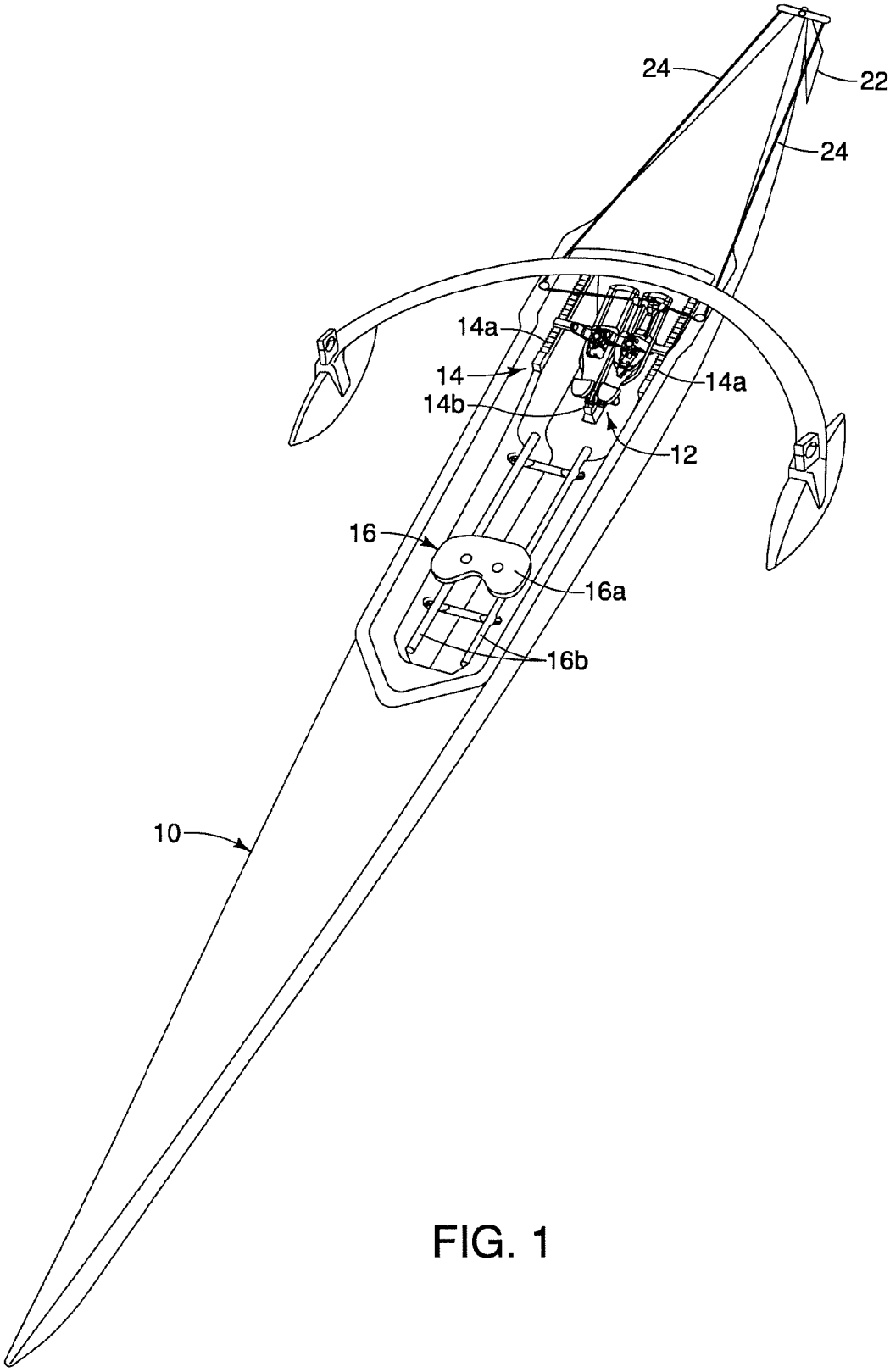
FIG. 1 is a perspective view of a rowing boat with a rowing boat footrest assembly in accordance with a first embodiment.

Referring initially to FIG. 1, a rowing boat 10 is illustrated that is equipped with a rowing boat footrest assembly 12 in accordance with a first embodiment. In this illustrated embodiment, the rowing boat 10 includes a stationary boat mounting structure 14 for supporting the rowing boat footrest assembly 12, and a sculling seat structure 16. While the rowing boat footrest assembly 12 is installed in a single person rowing boat in this illustrated embodiment, typically the boat footrest assembly 12 is installed in boats for two or more rowers such that one of the rowers can steer the boat with the boat footrest assembly 12. Thus, the boat footrest assembly 12 can be mounted in any type of rowing boat as needed and/or desired. Moreover, while the rowing boat 10 is illustrated as a single person sculling boat, the rowing boat footrest assembly 12 can be installed in other types of rowing boats such as a sweep-oar rowing boat where each rower has one oar held by both hand. The conventional oars of the rowing boat 10 are omitted for the sake of brevity and to provide greater clarity in the drawings. Likewise, other conventional parts (e.g., a sliding seat) of the rowing boat 10 are omitted for the sake of brevity.

The stationary boat mounting structure 14 can be a relatively conventional structure, as shown, that is rigidly fixed or rigidly supported to an interior portion or gunwale portion of the hull of the rowing boat 10. The hull of the rowing boat 10 can have any of a variety of conventional shapes and configurations depending upon whether the type of boat. More specifically, the size and shape of the hull of the rowing boat 10 can have any size and shape that can accommodate the rowing boat footrest assembly 12. It should be apparent to those skilled in the rowing boat field from the drawings and the description herein that the stationary boat mounting structure 14 can be a structure integrally formed with the hull of the rowing boat 10 or rigidly fixed to the hull of the rowing boat 10.

In this illustrated embodiment, the stationary boat mounting structure 14 includes a pair of side rails 14*a* and a center rail 14*b*. In particular, the side rails 14*a* are fixedly arranged parallel to one another along the sides of the hull of the boat 10, with the center rail 14*b* being arranged parallel to the side rails 14*a* along a center of the floor of the hull of the boat 10. In this illustrated embodiment, the side rails 14*a* are equidistant from the center rail 14*b*.

The sculling seat structure 16 includes a seat 16*a* and a pair of parallel rails 16*b*. One of the rails 16*b* is disposed on each of the lateral sides of the boat 10. The rails 16*b* slidably support the seat 16*a* to slide smoothly in a fore and aft (longitudinal) direction relative to the hull of the rowing boat 10. The seat 16*a* includes bearing portions such as rolling wheels or bushing surfaces that allow the seat 16*a* to slide along rails 16*b*. The sculling seat structure 16 can be a relatively conventional structure, as shown, and thus, the sculling seat structure 16 will not be discussed in detail herein.

Figure 2:
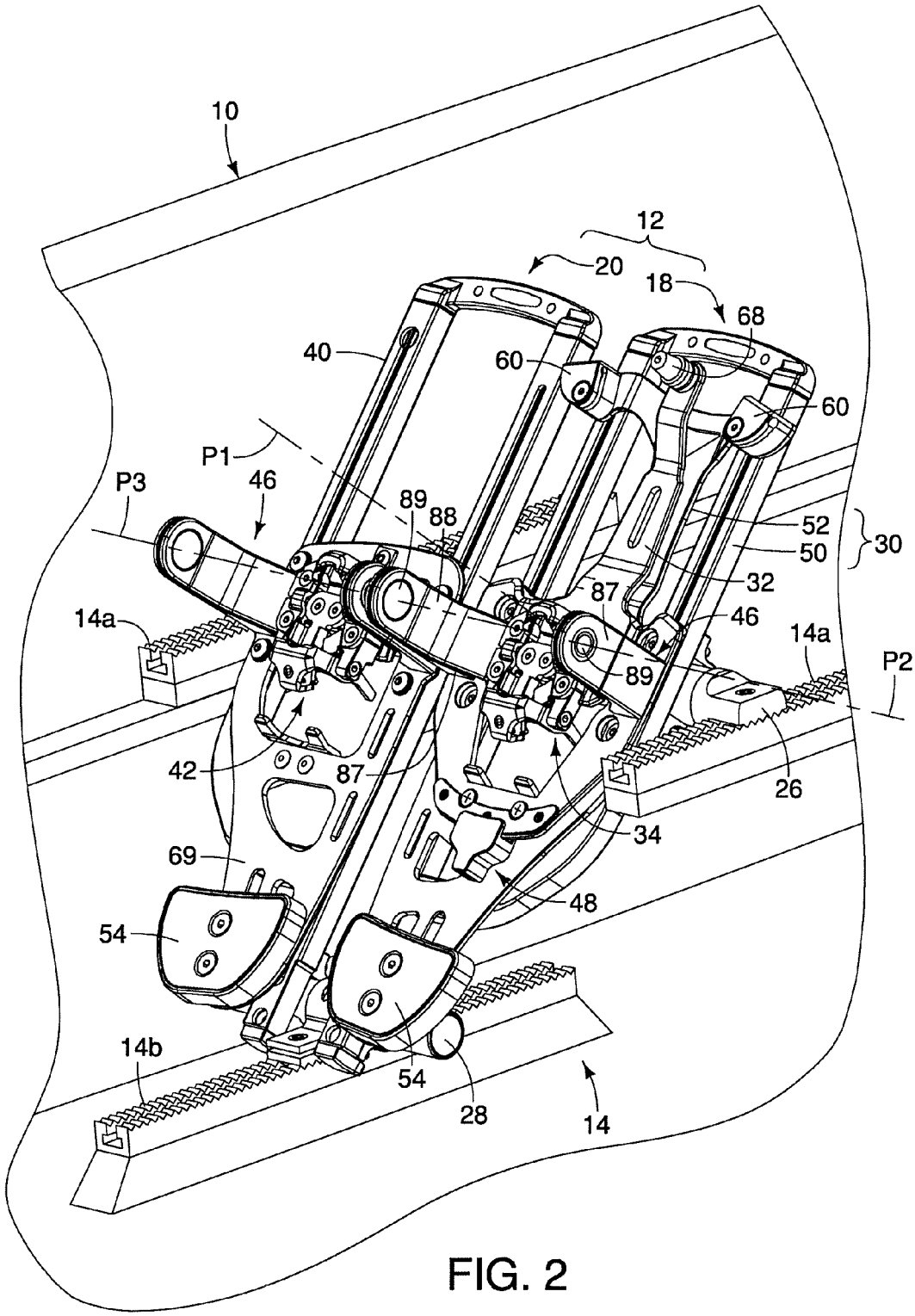
FIG. 2 is a partial perspective view of a portion of the hull of the rowing boat with the rowing boat footrest assembly illustrated in FIG. 1.

As best seen in FIG. 2, the rowing boat footrest assembly 12 basically includes a first (right) shoe support structure 18 and a second (left) shoe support structure 20. The first and second shoe support structures 18 and 20 collectively constitute a shoe support or a foot stretcher support. In this illustrated embodiment, the right shoe support structure 18 includes a rudder control function for controlling a rudder 22 of the rowing boat 10 as seen in FIG. 1. Basically, in this illustrated embodiment, only the rower's right foot is used to operate the rudder 22. The rower's left foot is not used to operate the rudder 22 in this illustrated embodiment.

Figure 3:
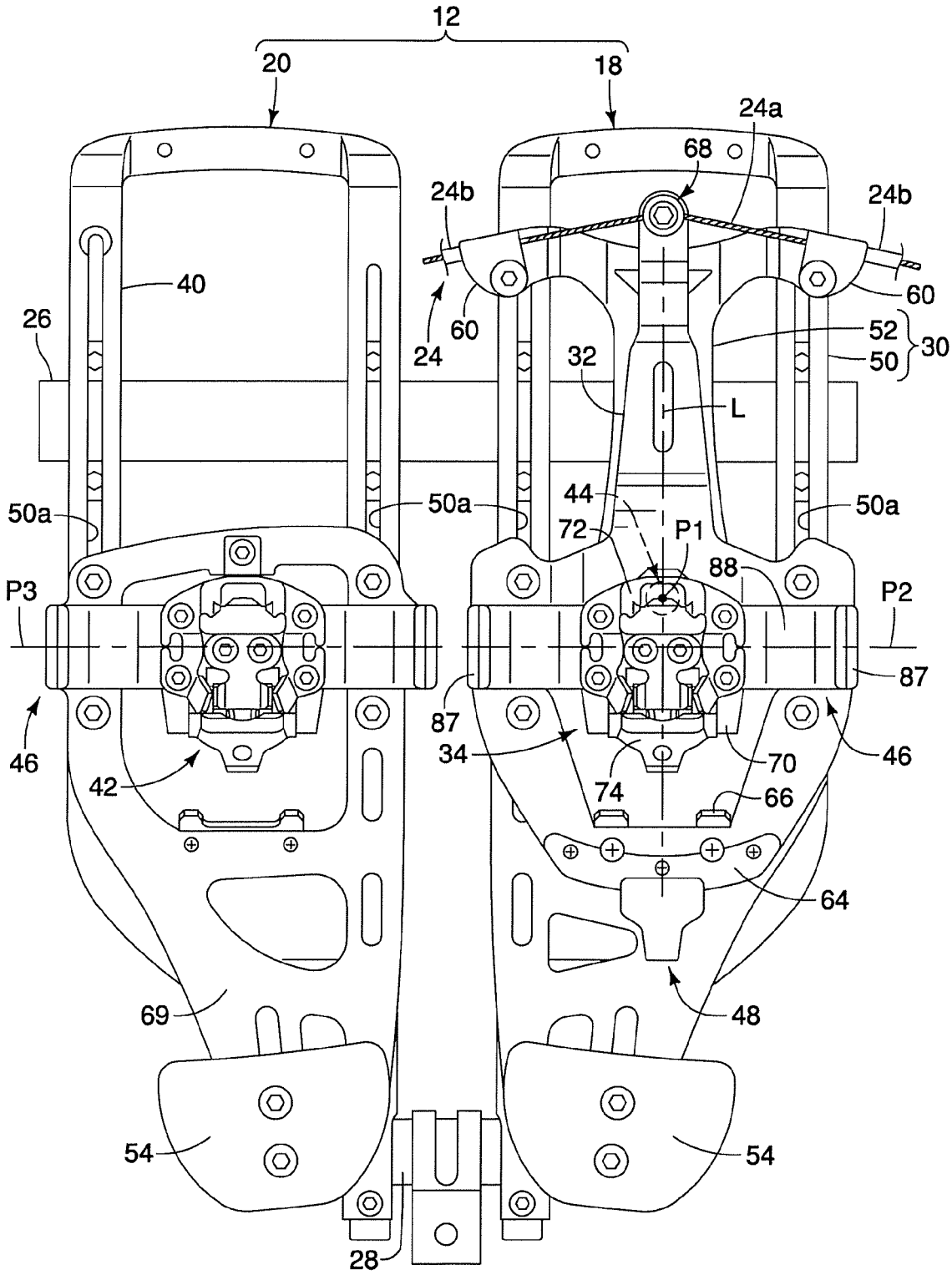
FIG. 3 is a top view of the rowing boat footrest assembly illustrated in FIGS. 1 and 2, with the right footrest in the center location for holding the rudder straight with respect to a longitudinal foot axis of the boat.

As seen in FIG. 1, the rudder 22 is pivotally attached to the stern of the hull of the rowing boat 10. The right shoe support structure 18 is operatively coupled to the rudder 22 by a cable 24 for turning the rudder 22 to steer the rowing boat 10. As seen in FIG. 3, the control cable 24 is a conventional cable such as Bowden cables that include an inner wire 24*a* and outer casings 24*b*. While in this illustrated embodiment, only the right shoe support structure 18 is used to operate the rudder 22, it will be apparent to those skilled in the art from this disclosure that the rudder 22 can be operated by using only the left shoe support structure 20, if needed and/or desired. Alternatively, the right and left shoe support structures 18 and 20 can be configured such that both of the right and left shoe support structures 18 and 20 can be used to operate the rudder 22, if needed and/or desired.

As seen in FIG. 2, the first and second shoe support structures 18 and 20 are adjustably coupled to the stationary boat mounting structure 14 in both lateral and longitudinal directions of the rowing boat 10 as explained below. In this illustrated embodiment, the right and left shoe support structures 18 and 20 are mounted to the side rail 14*a* of the stationary boat mounting structure 14 by a lateral cross support bar 26 and mounted to the center rail 14*b* by a center support bar 28. In this illustrated embodiment, the lateral cross support bar 26 is adjustably mounted on the side rails 14*a*, while the center support bar 28 is adjustably mounted to the center rail 14*b*. In this way, the lateral cross support bar 26 and the center support bar 28 can be selectively position along the rails 14*a* and 14*b*. Thus, the longitudinal positions of the first and second shoe support structures 18 and 20 can be longitudinally adjusted with respect to the hull of the rowing boat 10.

As seen in FIGS. 3 to 7, the right shoe support structure 18 of the rowing boat footrest assembly 12 basically includes a base 30, a foot-rudder control member 32 and a footrest member 34, while the left shoe support structure 20 basically includes a base 40 and a footrest member 42. The bases 30 and 40 of the right and left shoe support structures 18 and 20 are fixedly mounted to the support bars 26 and 28 in a laterally adjustable manner. In particular, in this illustrated embodiment, the right and left shoe support structures 18 and 20 are independent units which are independently adjustable in the lateral direction of the rowing boat 10 on the support bars 26 and 28. However, it will be apparent to those skilled in the art from this disclosure that this adjustment feature does not need to be included in the rowing boat footrest assembly 12. Once the bases 30 and 40 of the right and left shoe support structures 18 and 20 are in a fixed position on the support bars 26 and 28, the bases 30 and 40 are stationary with respect to the hull of the rowing boat 10. As explained below, the footrest member 34 is mounted on the foot-rudder control member 32 so that the rower can move the foot-rudder control member 32 relative to the base 30 to operate the rudder 22. In other words, the rower's shoe is disposed on the foot rest 34 to operate the foot-rudder control member 32 which in turn operates the rudder 22. In the normal rowing position, the rower's shoe has a longitudinal axis L that bisects the foot-rudder control member 32 in this illustrated embodiment.

In this illustrated embodiment, a first pivot structure 44 is provided between the base 30 and the foot-rudder control member 32 so that the first pivot structure 44 pivotally supports the foot-rudder control member 32 on the base 30. The first pivot structure 44 defines a first pivot axis P1 of pivotal movement between the base 30 and the foot-rudder control member 32. In other words, the foot-rudder control member 32 pivots relative to the base 30 along an arc having its center located at the first pivot axis P1. Thus, the foot-rudder control member 32 pivots about the first pivot axis P1 relative to the base 30.

In this illustrated embodiment, when the foot-rudder control member 32 is pivoted about the first pivot axis P1 to the right relative to the base 30, the rudder 22 is turned the left (counterclockwise as viewed from above). On the other hand, when the foot-rudder control member 32 is pivoted about the first pivot axis P1 to the left relative to the base 30, the rudder 22 is turned the right (clockwise as viewed from above). Of course, the connection between the rudder 22 and the foot-rudder control member 32 can be modified so that the rudder 22 is turns in the same direction of the movement of the foot-rudder control member 32 if needed and/or desired.

Also in this illustrated embodiment, a second pivot structure 46 is provided between the foot-rudder control member 32 and the footrest member 34 so that second pivot structure 46 pivotally supports the footrest member 34 on the foot-rudder control member 32 to change a shoe inclination of the footrest member 34 with respect to the foot-rudder control member 32. The second pivot structure 46 defining a second pivot axis P2 of pivotal movement between the footrest member 34 and the foot-rudder control member 32. In other words, the footrest member 34 pivots relative to the foot-rudder control member 32 along an arc having its center located at the second pivot axis P2. Thus, the footrest member 34 pivots about the second pivot axis P2 relative to the foot-rudder control member 32.

In this illustrated embodiment, the first pivot structure 44 is arranged with respect to the second pivot structure 46 such that the second pivot axis P2 is adjacent the first pivot axis P1 with respect to in a longitudinal direction (i.e., along axis L) of a rower's shoe disposed on the foot rest 34 in the normal rowing position. The second pivot axis P2 is not parallel to the first pivot axis P1. In particular, in this illustrated embodiment, the first and second pivot axes P1 and P2 are substantially perpendicular (i.e., ±5° from 90°). The first pivot structure 44 is arranged with respect to the second pivot structure 46 such that the first pivot axis P1 is disposed within twenty millimeters of the second pivot axis P2 with respect to the longitudinal direction (i.e., along axis L) of a rower's shoe that is disposed on the foot rest 34 in the normal rowing position. In this illustrated embodiment, the first pivot structure 44 is arranged with respect to the second pivot structure 46 such that the first pivot axis P1 is disposed within fifteen millimeters towards to a toe end of the foot-rudder control member 32 from the second pivot axis P2. Thus, in this illustrated embodiment, the first pivot structure 44 is arranged with respect to the second pivot structure 46 such that the first pivot axis P1 is disposed being closer to a toe end of the foot-rudder control member 32 than is the second pivot axis P2 with respect to the toe end of the foot-rudder control member 32.

In this illustrated embodiment, the right shoe support structure 18 is further provided with a positioning structure 48 that selectively retains the foot-rudder control member 32 from pivoting on the first pivot axis P1 to maintain the foot-rudder control member 32 in a center position with respect to the base 30. When the foot-rudder control member 32 in the center position by the positioning structure 48, the rudder 22 is held in the non-angled (center) position with respect to the boat 10. While the positioning structure 48 is illustrated with only one position, several positions can be provided if needed and or desired.

Turning now to FIGS. 2 to 5, the base 30 of the right shoe support structure 18 will now be discussed in more detail. The base 30 includes a frame part 50 and a support plate 52. The frame part 50 and the support plate 52 are rigid members that are constructed of a suitable rigid material. For example, the frame part 50 can be constructed of metal tubing (e.g., aluminum) or non-metallic tubing (e.g., a fiber reinforced polymer), while the support plate 52 can be constructed of a metal plate (e.g., aluminum) or a non-metallic plate (e.g., a fiber reinforced polymer). The support plate 52 is fixed to an upper surface of the frame part 50 as an integrated unit. A heel support member 54 is adjustably mounted on a lower end of the support plate 52 of the base 30 for adjustment in a 3.

Figure 4:
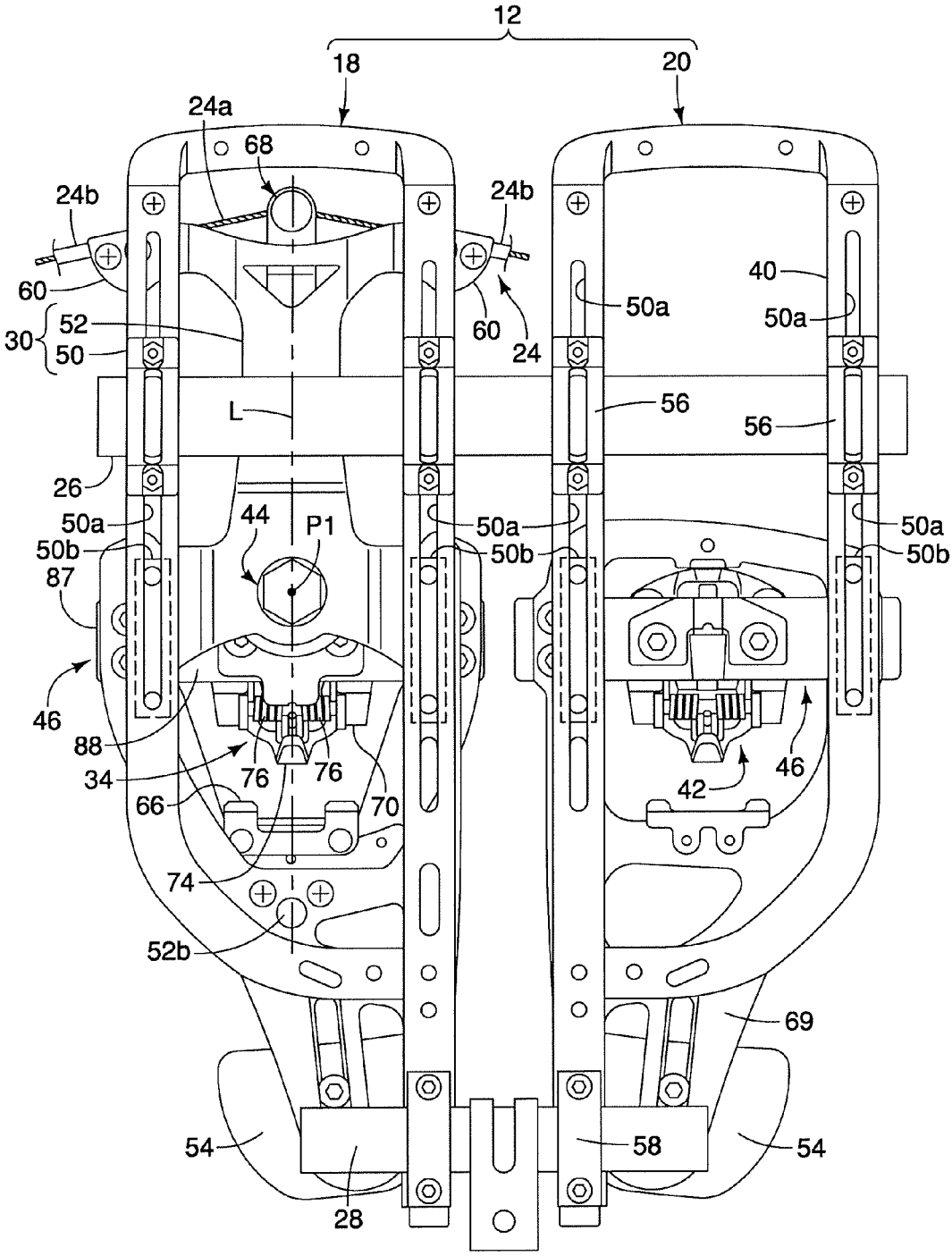
FIG. 4 is a bottom view of the rowing boat footrest assembly illustrated in FIGS. 1 to 3, with the right footrest in the center location for holding the rudder straight with respect to the longitudinal foot axis of the boat.
Figure 5:
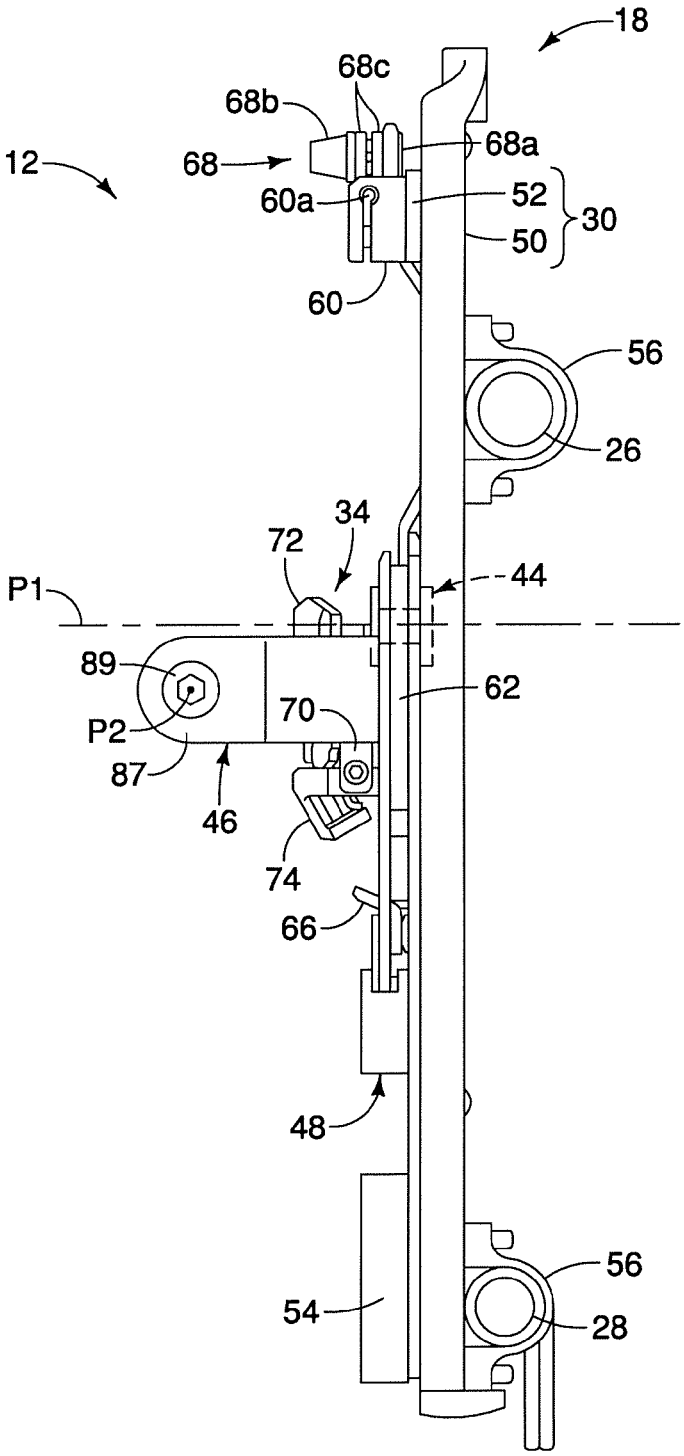
FIG. 5 is a side view of the rowing boat footrest assembly illustrated in FIGS. 1 to 4.
Figure 6:
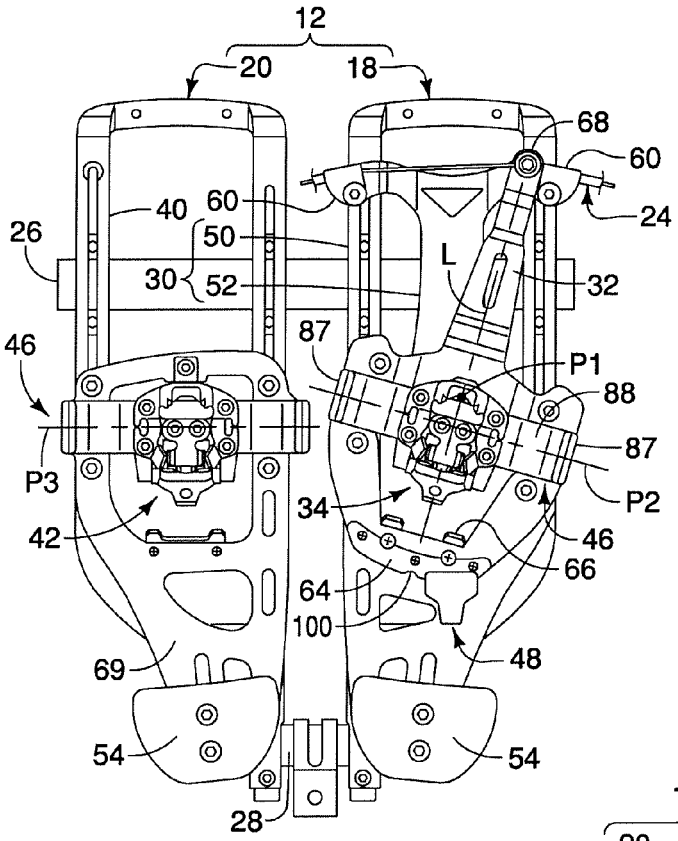
FIG. 6 is a top view of the rowing boat footrest assembly illustrated in FIGS. 1 and 2, with the right footrest pivoted to the right end location for turning the rudder in an angled position with respect to the longitudinal foot axis of the boat.
Figure 7:
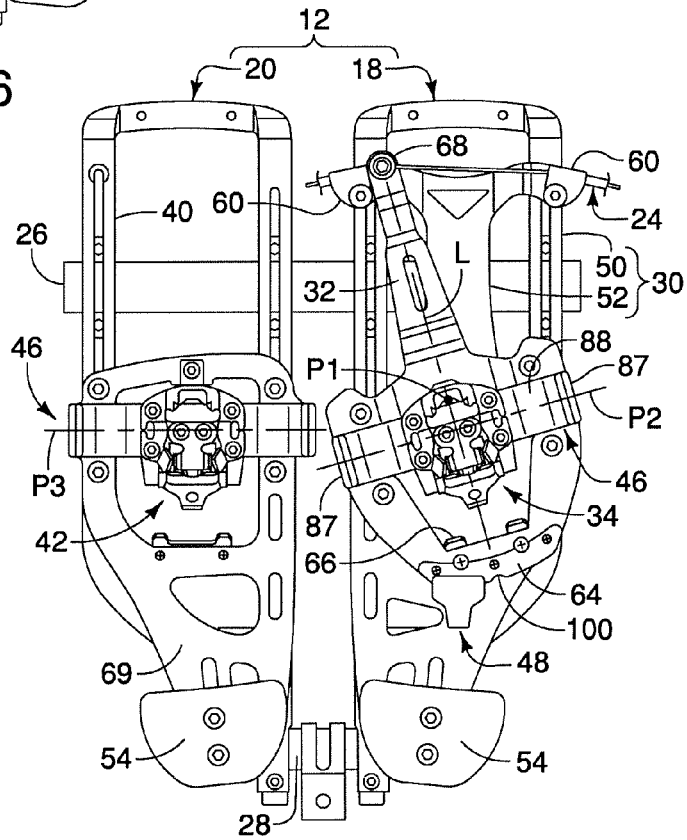
FIG. 7 is a top view of the rowing boat footrest assembly illustrated in FIGS. 1 and 2, with the right footrest pivoted to the left end location for turning the rudder in an angled position with respect to the longitudinal foot axis of the boat.

The frame part 50 is formed of a plurality of tubular members. As best seen in FIGS. 4 and 5, the lower surface of the frame part 50 is provided with a pair of toe end U-shaped brackets 56 and one heel end U-shaped bracket 58. The U-shaped brackets 56 are configured and arranged for attachment to the lateral cross support bar 26. The U-shaped bracket 58 is configured and arranged for attachment to the center support bar 28. In this illustrated embodiment, the frame part 50 has two mounting slots 50*a* with one attachment part 50*b* disposed in each of the mounting slots 50*a* for adjustably mounting the support plate 52 to the attachment parts 50*b* via a plurality of fasteners. Thus, the support plate 52 is longitudinal adjustable with respect to the frame part 50.

Figure 8:
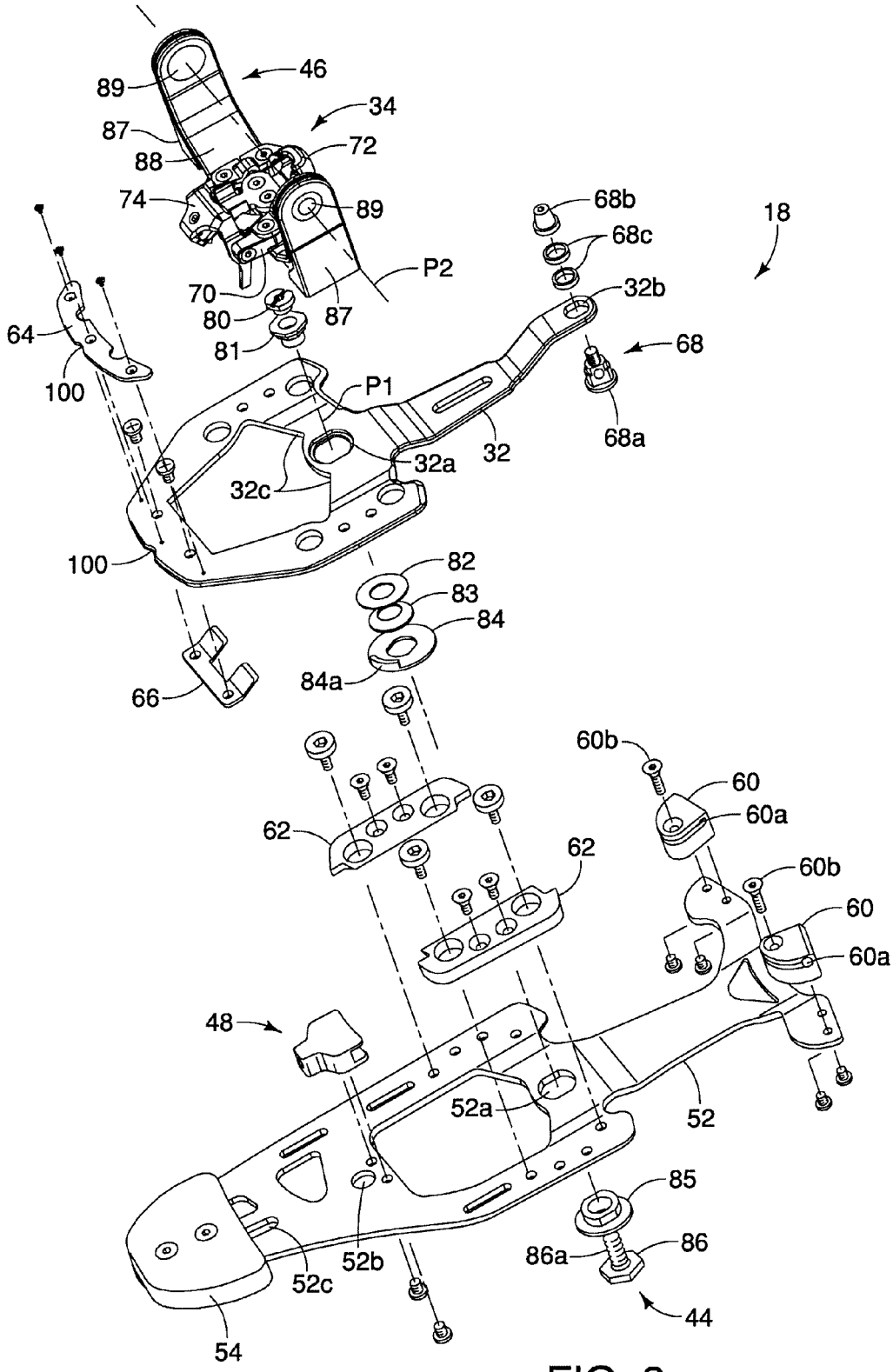
FIG. 8 is an exploded, perspective view of selected parts of the right footrest of the rowing boat footrest assembly illustrated in FIGS. 1 to 7.

As seen in FIGS. 2 to 8, the support plate 52 includes a pair of outer casing abutment members 60. The outer casing abutment members 60 are each attached to the support plate 52 of the base 30 by a pair of screws or other suitable fasteners. Thus, the outer casing abutment members 60 are stationary members with respect to the boat 10. As seen in FIG. 8, each of the outer casing abutment members 60 has a slot 60*a* and a bolt 60*b*. The bolt 60*b* is configured and arranged to change the dimension of the slot 60*a* for gripping one end of a corresponding one of the outer casings 24*b* of the control cable 24. The slots 60*a* are dimensioned for allowing the inner wire 24*a* of the control cable 24 to pass therethrough. In other words, the outer casing abutment members 60 are configured and arranged on the support plate 52 so that the inner wire 24*a* of the control cable 24 passes through the outer casing abutment members 60, while ends of the outer casings 24*b* of the control cable 24 abut against the outer casing abutment members 60. In this way, the inner wire 24*a* of the control cable 24 slid relative to the outer casings 24*b* of the control cable 24 when the foot-rudder control member 32 is pivoted about the first pivot axis P1.

Figure 13:
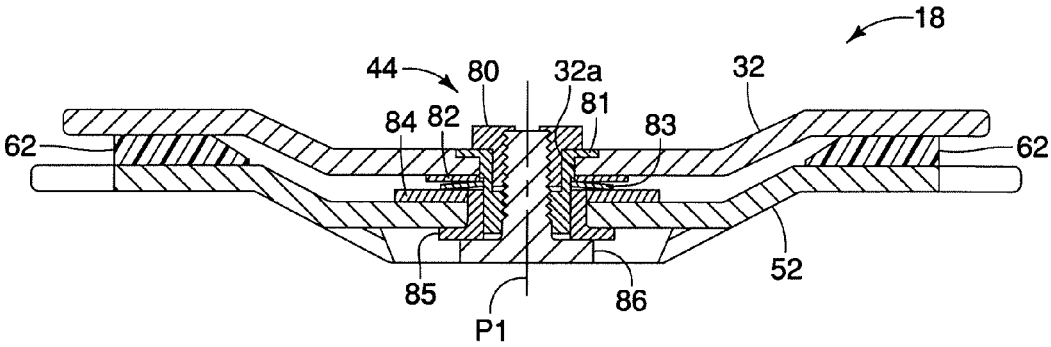
FIG. 13 is a cross sectional view of the right footrest of the rowing boat footrest assembly illustrated in FIGS. 1 to 9 as seen along section line 13-13 of FIG. 9, which extends through the first pivot structure of the right footrest.

In this illustrated embodiment, as seen in FIGS. 5, 8 and 13, the support plate 52 has two resin bearing plates 62 that are fixed to its upper surface. The bearing plates 62 (bearing materials) are disposed between the base 30 and the foot-rudder control member 32 for slidably supporting the foot-rudder control member 32 with respect to the base 30. The bearing plates 62 are constructed of a bearing material having a lower coefficient of friction that the material of the upper surface of the support plate 52 to which the bearing plates 62 are attached. As seen in FIG. 8, the bearing plates 62 are attached to the support plate 52 of the base 30 by a pair of screws (not numbered) or other suitable fasteners. Of course, alternatively, it will be apparent from this disclosure that the bearing plates 62 can be attached to the foot-rudder control member 32.

As seen in FIGS. 2, 3, 6 and 7, the positioning structure 48 is attached to the support plate 52, and engages the foot-rudder control member 32 for selectively retaining the foot-rudder control member 32 in the center position with respect to the base 30. In this illustrated embodiment, the positioning structure 48 is fixedly attached to the support plate 52 by a pair of screws (not numbered) as seen in FIGS. 4 and 8.

As seen in FIG. 8, the support plate 52 has a pivot opening 52*a*, an access opening 52*b* and a heel adjustment slot 52*c*. The pivot opening 52*a* is a non-circular opening with a pair of flat sides. The access opening 52*b* is a circular opening. The heel adjustment slot 52*c* is an elongated opening. The pivot opening 52*a* is configured and arranged to receive the first pivot structure 44 as discussed below. The access opening 52*b* is configured and arranged to aid in the installation and/or disablement of the positioning structure 48 as discussed below. The heel adjustment slot 52*c* is configured and arranged to receive a pair of screws (not numbered) for adjusting the position of the heel support member 54.

Figure 9:
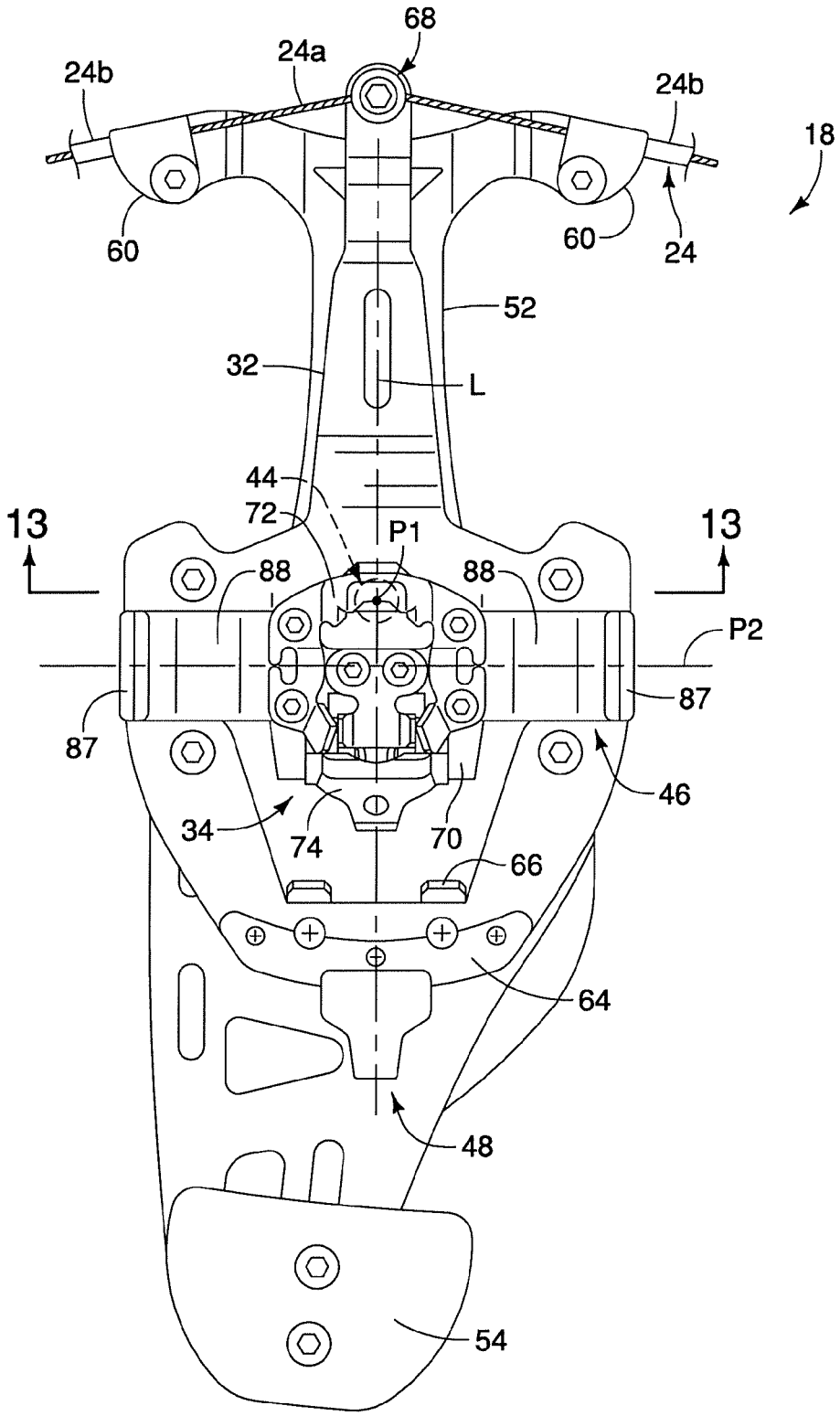
FIG. 9 is a top view of the right footrest of the rowing boat footrest assembly illustrated in FIGS. 1 to 8, with the right footrest in the center location.
Figure 10:
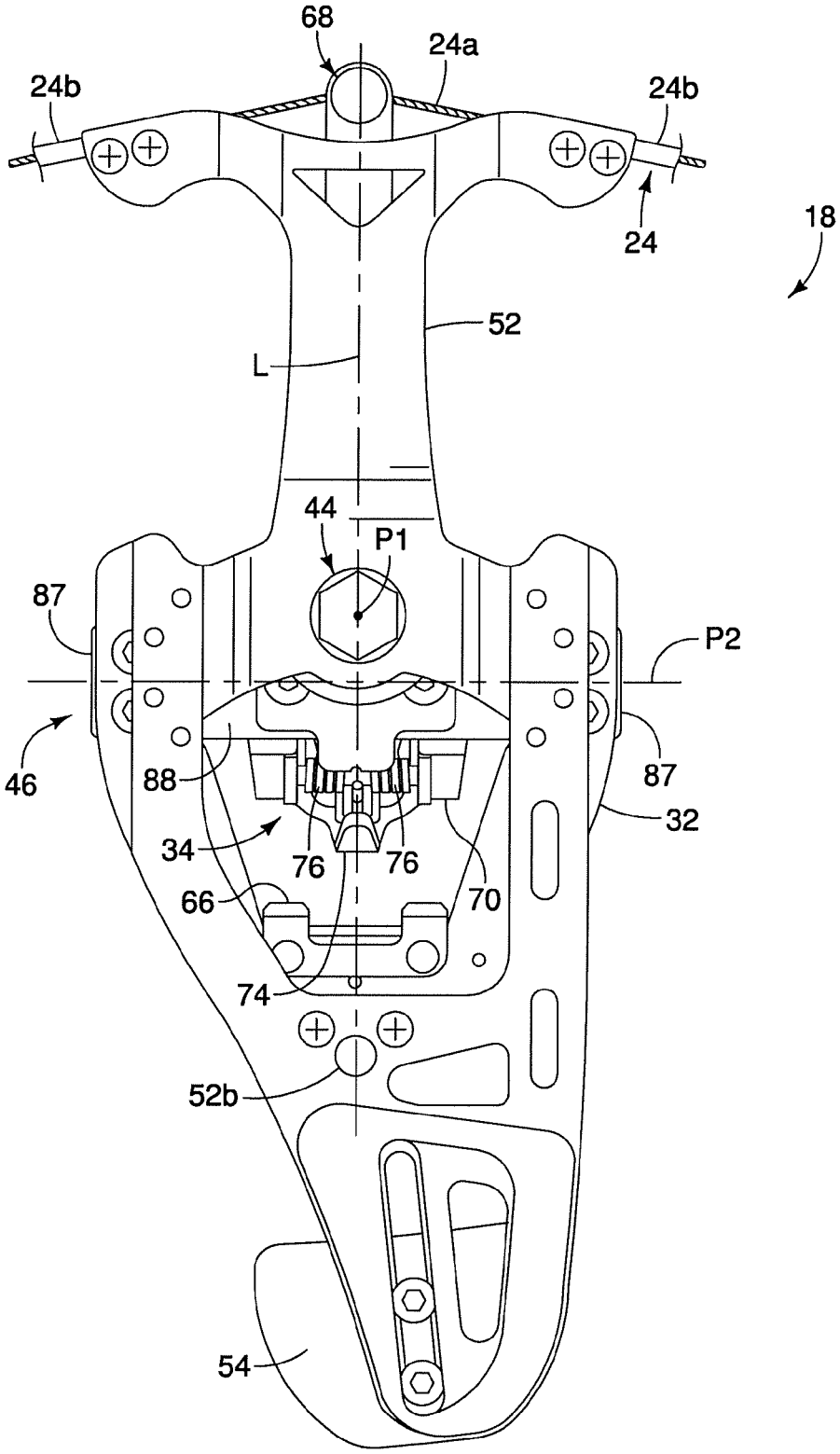
FIG. 10 is a bottom view of the right footrest of the rowing boat footrest assembly illustrated in FIGS. 1 to 9, with the right footrest in the center location.

Referring to FIGS. 3, 8 and 9, the foot-rudder control member 32 of the right shoe support structure 18 will now be discussed in more detail. In this illustrated embodiment, the foot-rudder control member 32 is a rigid member that is constructed of a suitable rigid material such as a metal plate (e.g., aluminum) or a non-metallic plate (e.g., a fiber reinforced polymer). As mentioned above, the first pivot structure 44 pivotally supports the foot-rudder control member 32 on the base 30 for pivotal movement on the first pivot axis P1.

In this illustrated embodiment, as seen in FIGS. 8 and 9, the foot-rudder control member 32 includes a resin control plate 64 and a release lever plate 66. The control plate 64 is fixed to the upper surface of the foot-rudder control member 32 by three screws (not numbered). The release lever plate 66 is fixed to its lower surface of the foot-rudder control member 32 by two screws (not numbered) with a portion of the release lever plate 66 projecting above the upper surface of the foot-rudder control member 32. The resin control plate 64 is configured and arranged to form part of the positioning structure 48 as discussed below. The release lever plate 66 is configured and arranged to cooperate with the footrest member 34 to release the rower's shoe from the footrest member 34 as discussed below.

As seen in FIG. 8, in this illustrated embodiment, the foot-rudder control member 32 is a pivotal support plate that is formed of a suitable rigid material. The foot-rudder control member 32 basically has a pivot opening 32*a*, an attachment opening 32*b* and a pair of abutments 32*c*. The pivot opening 32*a* is a non-circular opening with a pair of flat sides. The attachment opening 32*b* is also a non-circular opening with a pair of flat sides. The pivot opening 32*a* is configured and arranged to receive the first pivot structure 44 as discussed below. The attachment opening 32*b* is configured and arranged to receive a rudder control attachment 68 such that the rudder control attachment 68 is fixed to the foot-rudder control member 32. The abutments 32*c* cooperate with the first pivot structure 44 to limit the pivotal movement between the foot-rudder control member 32 and the base 30 as discussed below.

In this illustrated embodiment, as seen in FIGS. 5 and 8, the rudder control attachment 68 includes an inner wire fixing bolt 68*a*, an inner wire fixing nut 68*b* and a pair of an inner wire fixing washers 68*c*. Basically, the inner wire 24*a* is inserted into a transverse hole in the shaft of the inner wire fixing bolt 68*a* and the inner wire fixing nut 68*b* is screwed onto the threaded portion of the shaft of the inner wire fixing bolt 68*a* for squeezing the inner wire 24*a* between the inner wire fixing washers 68*c*. The shaft of the inner wire fixing bolt 68*a* is provided with a non-circular portion that mates with the non-circular attachment opening 32*b* to prevent relative movement between the foot-rudder control member 32 and the inner wire fixing bolt 68*a*.

Referring to FIGS. 2 to 4, 6 and 7, the left shoe support structure 20 will now be discussed in more detail. The left shoe support structure 20 uses some of the same parts that are used in the right shoe support structure 18. Generally, those parts that are the same in the right and left shoe support structures 18 and 20 will be given the same reference numerals. Moreover, the descriptions of those parts of the left shoe support structure 20 that are identical to the parts of the right shoe support structure 18 will be omitted for the sake of brevity.

As mentioned above, the left shoe support structure 20 basically includes the base 40, the footrest member 42 and the heel support member 54. The footrest member 42 constitutes an additional footrest member with respect to the footrest member 34. The base 40 is stationary with respect to the boat 10, while the footrest member 42 is pivotally mounted to the base 40 to pivot about a third pivot axis P3. When the positioning structure 48 is retaining the foot-rudder control member 32 in the center position with respect to the base 30, the second and third pivot axes P2 and P3 are coincident as seen in FIG. 3.

In this illustrated embodiment, the second pivot structure 46 of the footrest member 34 is also used for pivotally supporting the footrest member 42 of the left shoe support structure 20 relative to the base 40. The pivot structure 46 of the footrest member 42 constitutes a third pivot structure pivotally supporting the footrest member 42 on the base 40 to change a shoe inclination of the footrest member 42 with respect to the base 40. The (third) pivot structure 46 of the footrest member 42 defines the third pivot axis P3 of pivotal movement between the additional footrest member 42 and the base 40. The first and third pivot axes P1 and P3 are substantially perpendicular to each other. However, the footrest member 42 of the left shoe support structure 20 is fixed to a support plate 69. The support plate 69 is fixed by four bolts to the base 40 in a longitudinal adjustable manner. Thus, the footrest member 42 cannot be used to operate the rudder 22 in this illustrated embodiment.

In this illustrated embodiment, the footrest members 34 and 42 are identical. Thus, only the footrest member 34 will be discussed. The footrest member 34 is supported on the foot-rudder control member 32 to pivot or swing about the second pivot axis P2 with respect to the foot-rudder control member 32. In this illustrated embodiment, the footrest member 34 is a cleat type shoe attachment mechanism. In such a clipless type shoe attachment mechanism, a shoe includes a cleat or attachment part (not shown) that is releasably retained by the footrest member 34 in a conventional manner.

Basically, the footrest member 34 includes a support part 70, a front cleat retraining member 72, a rear cleat retraining member 74 and a pair of biasing elements 76. The support part 70 of the footrest member 34 is fixedly attached to the second pivot structure 46 such that the footrest member 34 pivots or swings about the second pivot axis P2 with respect to the foot-rudder control member 32. The front cleat retraining member 72 is fixed to the support part 70 of the footrest member 34, while the rear cleat retraining member 74 is pivotally coupled to the support part 70 of the footrest member 34 by a pivot pin. The biasing elements 76 are torsion springs that are mounted on the pivot pin of the rear cleat retraining member 74 for urging the rear cleat retraining member 74 to a cleat engaging position. Thus, the cleat retraining members 72 and 74 with the biasing elements 76 constitute a step-in shoe attachment structure of the footrest member 34. The first pivot axis P1 is located adjacent the step-in shoe attachment structure of the footrest member 34. In this illustrated embodiment, the first pivot axis passes through the front cleat retraining member 72 of the step-in shoe attachment structure of the footrest member 34.

When the footrest member 34 is pivoted or swung about the second pivot axis P2 so that the rear cleat retraining member 74 contacts the release lever plate 66, further movement of the footrest member 34 against the release lever plate 66 cause the rear cleat retraining member 74 to pivot to a cleat releasing position against the urging forces of the biasing elements 76. In this way, the rower's shoe can be easily released from between the cleat retraining members 72 and 74. A similar clipless type shoe attachment mechanism is disclosed in U.S. patent application Ser. No. 12/361,594, filed on Jan. 29, 2009 and assigned to Shimano Inc. Other examples of clipless type shoe attachment mechanisms are disclosed in U.S. Pat. No. 6,119,551 assigned to Shimano Inc. and U.S. Pat. No. 6,925,908 assigned to Shimano Inc.

In this illustrated embodiment, the right and left footrest members 34 and 42 are each independently adjustable in the longitudinal direction of the rowing boat 10. Also the right and left heel support members 54 are independently adjustable in the longitudinal direction of the rowing boat 10. However, it will be apparent to those skilled in the art from this disclosure that these adjustment features do not need to be included in the rowing boat footrest assembly 12.

Referring to FIGS. 11 to 14, the first pivot structure 44 will now be discussed in more detail. In this illustrated embodiment, the first pivot structure 44 includes a pivot nut 80, an upper pivot bushing 81, an upper pivot washer 82, a pivot biasing element 83, a lower pivot washer 84, a lower pivot bushing 85 and a pivot bolt 86. The longitudinal axis of the pivot bolt 86 of the first pivot structure 44 forms the first pivot axis P1. In this illustrated embodiment, the pivot nut 80 is located above the foot-rudder control member 32 and the pivot bolt 86 is located below the support plate 52. However, the arrangement of the parts of the first pivot structure 44 can be inverted if needed and/or desired.

Figure 14:
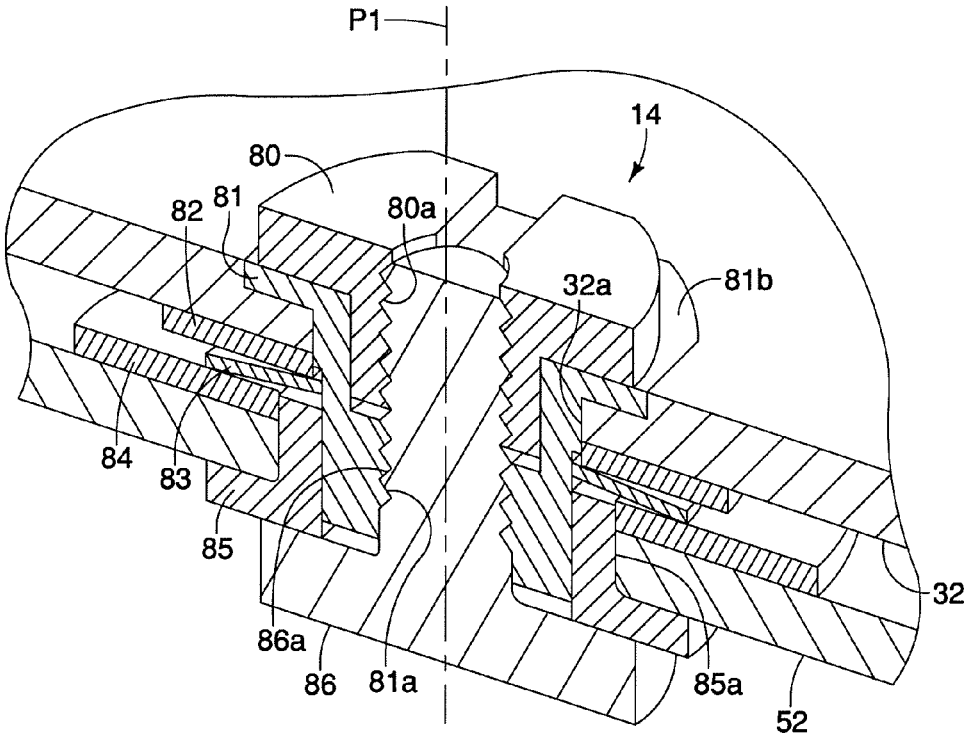
FIG. 14 is an enlarged, cross sectional view of the first pivot structure of the right footrest of the rowing boat footrest assembly illustrated in FIGS. 1 to 9 as seen along section line 14-14 of FIG. 12.
Figure 15:
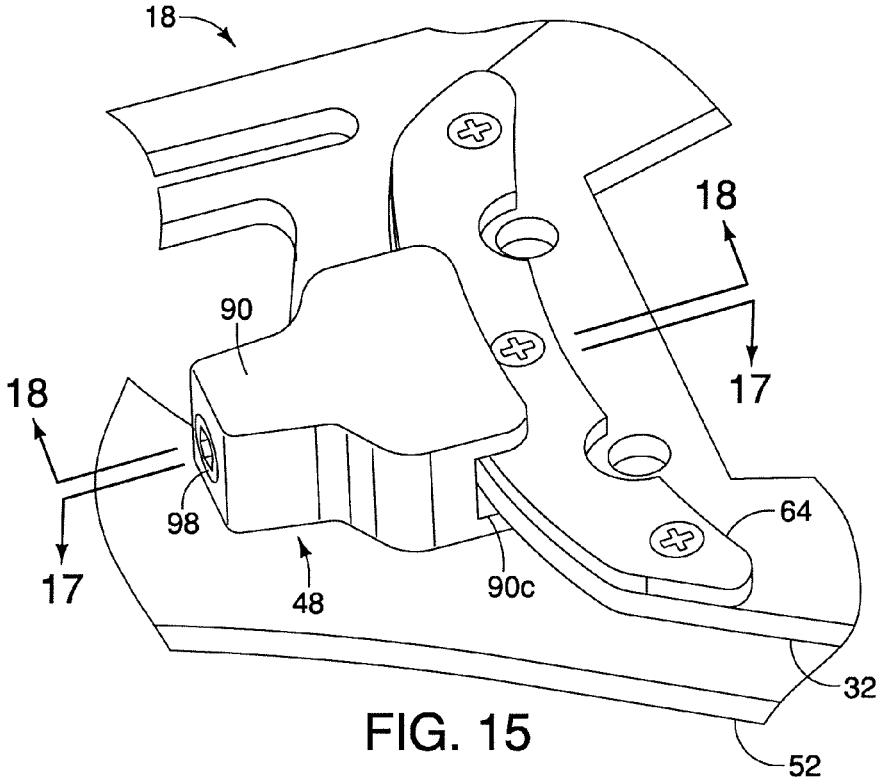
FIG. 15 is a perspective view of the positioning structure for the right footrest of the rowing boat footrest assembly illustrated in FIGS. 1 to 7, with the positioning structure maintaining the foot-rudder control member in the center location with respect to the base for holding the rudder straight with respect to the longitudinal foot axis of the boat.
Figure 16:
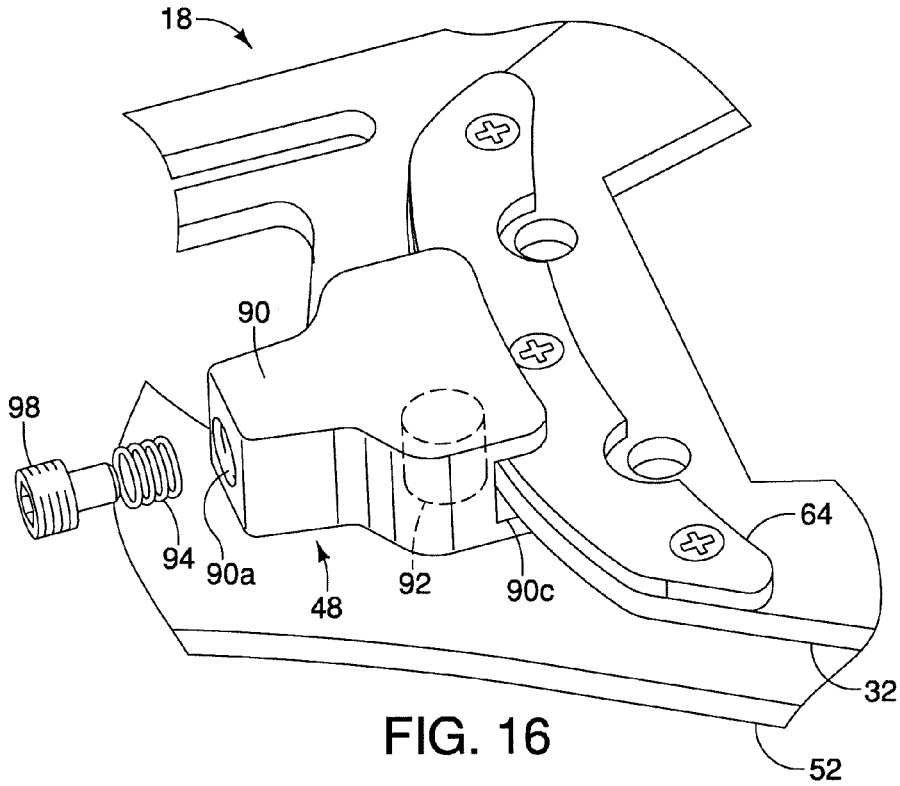
FIG. 16 is an exploded, perspective view of the positioning structure illustrated in FIG. 15.
Figure 17:
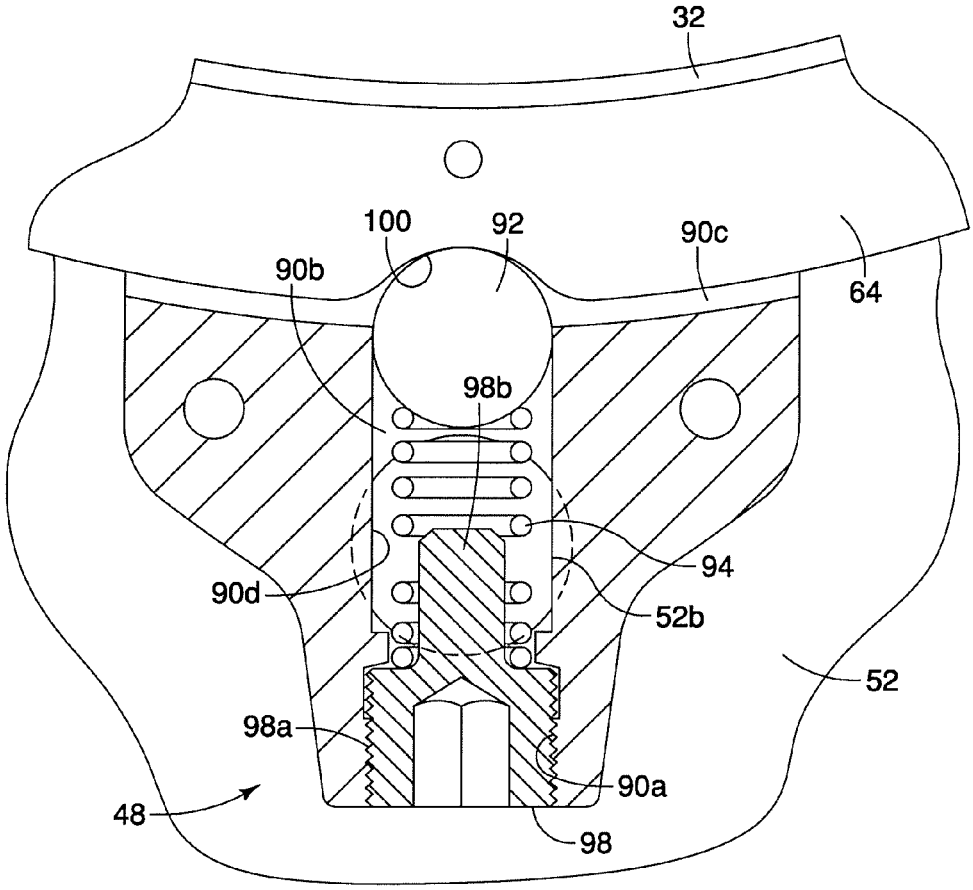
FIG. 17 is a cross sectional view of the positioning structure illustrated in FIGS. 15 and 16 as seen along section line 17-17 of FIG. 15, which corresponds to a plane that passes through the center of the threaded bore of the housing of the positioning structure and that is parallel to the upper surface of the base.
Figure 18:
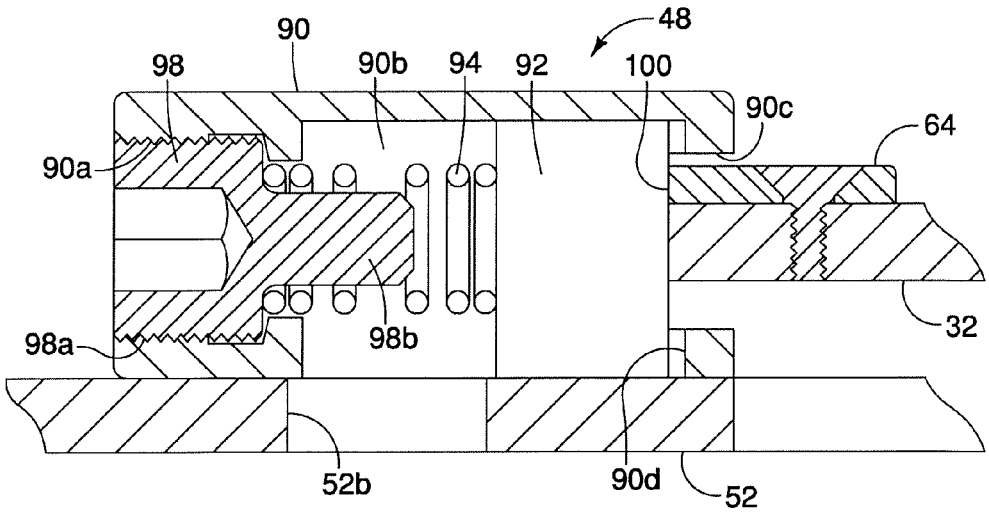
FIG. 18 is a cross sectional view of the positioning structure illustrated in FIGS. 15 to 17 as seen along section line 18-18 of FIG. 15, which corresponds to a plane that passes through the center of the threaded bore of the housing of the positioning structure and that is perpendicular to the upper surface of the support plate.

Basically, the pivot nut 80 is fixed on a shaft 86*a* of the pivot bolt 86. In particular, the pivot nut 80 is provided with a threaded bore 80*a*, as seen in FIG. 14, which engages a thread formed on the shaft 86*a* of the pivot bolt 86. The upper pivot bushing 81 is also provided with a threaded bore 81*a*, as seen in FIG. 14, which engages a thread formed on the shaft 86*a* of the pivot bolt 86. The upper pivot bushing 81 is also provided with a non-circular flange 81*b* that mates with a corresponding recess in the upper surface of the foot-rudder control member 32. The lower pivot bushing 85 is provided with a non-circular shaft 85*a* that mates with the non-circular opening 52*a* of the support plate 52. Thus, in this illustrated embodiment, the pivot nut 80, the upper pivot bushing 81 and the pivot bolt 86 all pivot together with respect to the lower pivot bushing 85 and the support plate 52.

In this illustrated embodiment, at least a portion of the threaded bore 80*a* of the pivot nut 80 is dimensioned to at least partially deform upon the thread of the shaft 86*a* of the pivot bolt 86 being screwed into the threaded bore 80*a* of the pivot nut 80. This arrangement of the threaded bore 80*a* of the pivot nut 80 is designed to prevent the pivot nut 80 from loosening from the pivot bolt 86. Since the pivot nut 80 is maintained in a set position on the shaft 86*a* of the pivot bolt 86, the upper pivot bushing 81 is also maintained in a set position on the shaft 86*a* of the pivot bolt 86, and an urging force of the biasing element 83 is maintained at a desired level.

The upper pivot bushing 81 is axially disposed between the pivot nut 80 and the foot-rudder control member 32 with respect the axial direction of the first pivot axis P1. As mentioned above, the upper pivot bushing 81 is threaded onto the shaft 86*a* of the pivot bolt 86, and is non-rotatably coupled to the foot-rudder control member 32 by the non-circular flange 81b that mates with a corresponding recess in the upper surface of the foot-rudder control member 32. Thus, the pivot bolt 86 is effectively fixed to the foot-rudder control member 32. Since the pivot nut 80 is threaded on the shaft 86*a* of the pivot bolt 86, the upper pivot bushing 81 is held in a set position by the pivot nut 80. In this way, the upper pivot bushing 81 is first threaded onto the shaft 86*a* of the pivot bolt 86 until the desired spacing between the foot-rudder control member 32 and the support plate 52 is attained to reach a desired biasing force between the foot-rudder control member 32 and the support plate 52 by the biasing element 83. After the upper pivot bushing 81 is set to the desired position, the pivot nut 80 is threaded on the shaft 86*a* of the pivot bolt 86 to retain the upper pivot bushing 81 in the desired position due to the deformation of the threaded bore 80*a* from the shaft 86*a* of the pivot bolt 86 being screwed into the threaded bore 80*a*.

As best seen in FIGS. 13 and 14, the upper pivot washer 82 is a flat metal washer that has a circular opening that receives a lower portion of the upper pivot bushing 81 therethrough. The upper pivot washer 82 is axially disposed between the foot-rudder control member 32 and the pivot biasing element 83 with respect to the axial direction of the first pivot axis P1.

The pivot biasing element 83 is disposed operatively between the support plate 52 of the base 30 and the foot-rudder control member 32 such that the pivot biasing element 83 applies an urging force biasing the foot-rudder control member 32 away from the support plate 52 of the base 30. More specifically, the pivot biasing element 83 is axially disposed between the upper pivot washer 82 and the lower pivot washer 84 with respect the axial direction of the first pivot axis P1. The pivot biasing element 83 includes at least one cone shaped spring (only one used in the illustrated embodiment). Accordingly, the pivot biasing element 83 is provided to obtain a desirable control friction of the foot-rudder control member 32. The desirable control friction can be obtained by adjusting tightening torque of the pivot bolt 86 to the upper pivot bushing 81. Once the pivot nut 80 is attached and deformed (fixed) to the pivot bolt 86, the control friction cannot be further adjusted.

Figure 11:
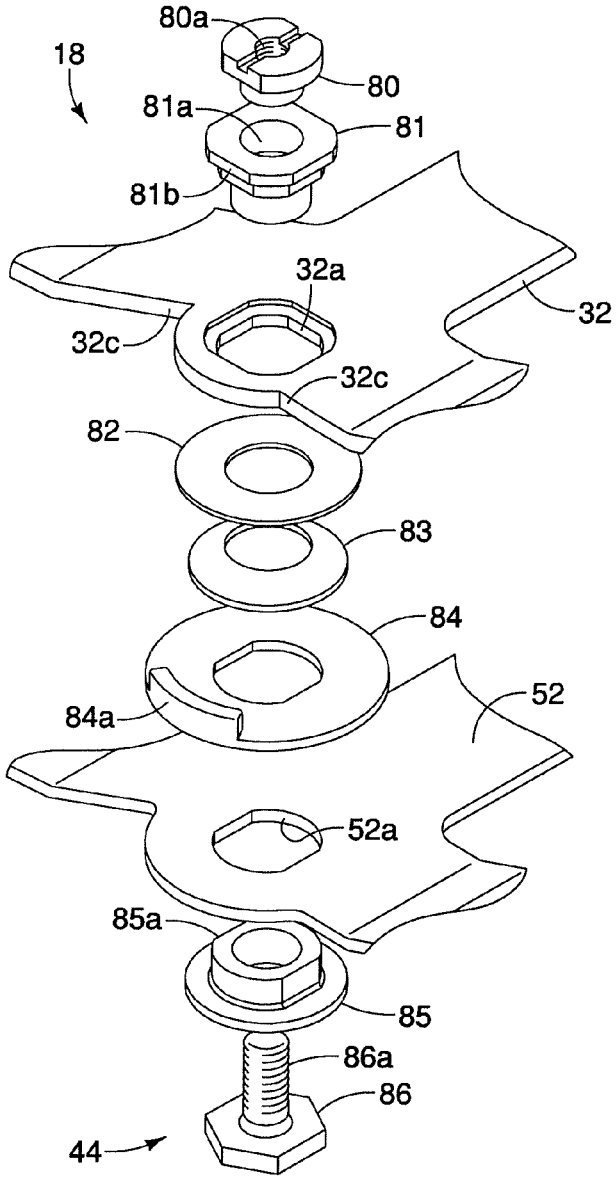
FIG. 11 is an exploded, perspective view of the first pivot structure of the right footrest that pivotally supports the foot-rudder control member on the base as illustrated in FIGS. 1 to 9.
Figure 12:
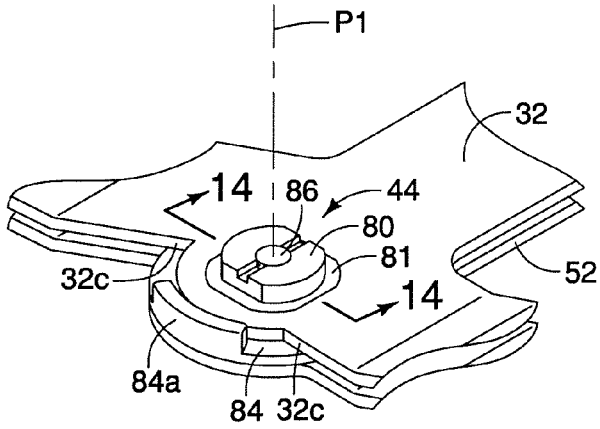
FIG. 12 is a perspective view of the first pivot structure of the right footrest that pivotally supports the foot-rudder control member on the base.

As seen in FIG. 11, the lower pivot washer 84 has a non-circular opening that mates with the non-circular shaft 85*a* so that the lower pivot washer does not rotate relative to the lower pivot bushing 85. Since the lower pivot bushing 85 is non-rotatably disposed on the support plate 52 of the base 30 in that the non-circular shaft 85*a* mates with the non-circular opening 52*a* of the support plate 52, the lower pivot washer 84 is also non-rotatably disposed on the support plate 52 of the base 30. However, the lower pivot washer 84 is rotatable with respect to the pivot bolt 86.

The lower pivot washer 84 has a projection 84*a* that is arranged with respect to the foot-rudder control member 32 to limit pivotal movement between the foot-rudder control member 32 with respect to the support plate 52 of the base 30. In particular, the projection 84*a* selectively contacts the abutments 32*c* of the foot-rudder control member 32 to limit pivotal movement between the foot-rudder control member 32 and the support plate 52 of the base 30.

As mentioned above, the lower pivot bushing 85 is non-rotatably coupled to the support plate 52 of the base 30 in that the non-circular shaft 85*a* of the lower pivot bushing 85 mates with the non-circular opening 52*a* of the support plate 52. The lower pivot bushing 85 is disposed on the shaft 86*a* of the pivot bolt 86 between the support plate 52 of the base 30 and the upper pivot bushing 81 that is non-rotatably coupled to the foot-rudder control member 32.

Referring back to FIGS. 6 to 9, the second pivot structure 46 will now be discussed in more detail. In this illustrated embodiment, the second pivot structure 46 basically includes a pair of support pillars 87 that are rigidly attached to the foot-rudder control member 32 and a swing member 88 that is pivotally attached to the support pillars 87 by a pair of pivot pins 89. In the illustrated embodiment, the support pillars 87 are each rigidly attached to the foot-rudder control member 32 by a pair of screws that are partially visible in FIG. 4. The swing member 88 is a rigid U-shaped member. The pivot pins 89 extend through openings in the upper portions of the swing member 88 and the upper portions of the support pillars 87 with the center of the pivot pins 89 forming the pivot axis P2. The pivot axis P2 of the swing member 88 is located above the footrest member 34. The support part 70 of the footrest member 34 is fixedly attached to the lower portion of the swing member 88 below the pivot axis P1 of the swing member 88 as can best be ascertained by FIGS. 2 and 5.

Referring mainly to FIGS. 15 to 18, the positioning structure 48 will now be discussed in more detail. In this illustrated embodiment, the positioning structure 48 that selectively retains the foot-rudder control member 32 from pivoting on the first pivot axis P1 to maintain the foot-rudder control member 32 in the center position (FIG. 3) with respect to the base 30. Thus, the positioning structure 48 is operatively coupled between the base 30 and the foot-rudder control member 32. The positioning structure 48 mainly includes a housing 90, a contact member 92, a biasing member 94, a setting member 98 and a notch or recess 100.

In this illustrated embodiment, the housing 90 is a separate member that is fixed to the support plate 52 of the base 30 by a pair of screws (FIG. 8). The housing 90 retains the contact member 92 and the biasing member 94 on the support plate 52 of the base 30 such that the biasing member 94 urges the contact member 92 into contact with the recess 100 that is formed in the resin control plate 64 and the foot-rudder control member 32. The setting member 98 is operatively coupled to the housing 90 so as to adjust the urging force of the biasing member 94 on the contact member 92.

However, the positioning structure 48 is not limited to this illustrated configuration. The positioning structure 48 can have other configurations such that certain parts are unified. For example, the housing 90 can be unified with either the foot-rudder control member 32 or the support plate 52, as need and/or desired. Also, the biasing member 94 can be unified with the contact member 92 such that the contact member 92 and the biasing member 94 are a one piece, unitary member. For example, a contact member and a biasing member can be made from a single bent leaf spring with a centrally located detent that forms the contact member. Also the setting member 98 can be arranged to some other member other than the housing 90. For example, a setting member can be arranged on the foot-rudder control member 32 so that the setting member 98 effectively varies the position of the notch with respect to the contract member.

In this illustrated embodiment, the housing 90 has a threaded bore 90*a*, a recess 90*b* and a slot 90*c*. The threaded bore 90*a* communicates with the recess 90*b* which in turn communicates with the slot 90*c*. The setting member 98 is screwed into the threaded bore 90*a*. The position of the setting member 98 with respect to the housing 90 can be adjusted based on the amount that the setting member 98 is screwed into the threaded bore 90*a*. In this way, the urging force of the biasing member 94 on the contact member 92 can be adjusted.

In this illustrated embodiment, the access opening 52*b* of the support plate 52 is at least partially aligned with the recess 90*b* of the housing 90 once the housing 90 is fixed to the support plate 52. The access opening 52*b* is a circular opening that is dimensioned for selectively inserting and/or removing the contact member 92 from the recess 90*b* of the housing 90 through the access opening 52*b* with the housing 90 being fixed to the support plate 52. Thus, the access opening 52*b* is configured and arranged to aid in the installation and/or disablement of the positioning structure 48.

The housing 90 also has a mounting surface 90*d* that faces an upper support surface of the support plate 52 of the base 30 to which the housing 90 is attached. This mounting surface 90*d* defines a periphery of the recess 90*b* of the housing 90. In other words, the mounting surface 90*d* includes the recess 90*b* that houses the contact member 92 and the biasing member 94.

In this illustrated embodiment, the contact member 92 is positioned in the recess 90*b* of the housing 90 and slidably retained on the upper surface of the support plate 52 of the base 30. While the contact member 92 is illustrated as a rod shaped member, it will be apparent from this disclosure that the contact member 92 can have other shapes as a sphere. The biasing member 94 is positioned in the recess 90*b* of the housing 90 between the contact member 92 and the setting member 98. Thus, the contact member 92 is biased towards the slot 90*c* of the housing 90. The slot 90*c* of the housing 90 receives a portion of the foot-rudder control member 32 in which the resin control plate 64 is attached. Thus, the biasing member 94 urges the contact member 92 into contact with the recess 100 that is formed the resin control plate 64 and the foot-rudder control member 32. The contact member 92 is located in the recess 100 of the foot-rudder control member 32 (e.g., the pivotal support plate) such that the foot-rudder control member 32 is held in the predetermined angular position of with respect to the base 30. In this illustrated embodiment, the predetermined angular position is an intermediate position between two end positions of a prescribed range of pivotal movement of the foot-rudder control member 32 with respect to the base 30.

In particular, as mentioned above, in this illustrated embodiment, the foot-rudder control member 32 constitutes a pivotal support plate. The contact member 92 is biased into contact with a peripheral edge of the pivotal support plate that forms at least a part of the foot-rudder control member 32. Thus, the slot 90*c* of the housing 90 receives a portion of the peripheral edge of the foot-rudder control member 32 (e.g., the pivotal support plate), which is movably disposed in the slot 90*c* of the housing 90. Also a portion of the contact member 92 is movably disposed in the slot 90*c* of the housing 90. In this way, in this illustrated embodiment, the peripheral edge of the foot-rudder control member 32 has the recess 100 for selectively receiving the contact member 92 to maintain the foot-rudder control member 32 in a predetermined angular position (e.g., a center position in the illustrated embodiment) with respect to the base 30 unless a force is applied that overrides urging force of the biasing member 94 on the contact member 92.

In this illustrated embodiment, the biasing member 94 is a coil compression spring that is preload in its assembled position to apply an urging force on the contact member 92 for biasing the contact member 92 into contact with the recess 100 on the peripheral edge of the foot-rudder control member 32. The biasing member 94 has one end directly contacting the setting member 98 and the other end directly contacting the contact member 92.

In this illustrated embodiment, the setting member 98 is adjustably arranged to change the urging force of the biasing member 94 on the contact member 92. Thus, the setting member 98 constitutes a biasing force adjustment setting member of the positioning structure 48. The setting member 98 has a threaded portion 98*a* and a projection 98*b*. The setting member 98 is threadedly disposed in the threaded bore 90*a* of the housing 90. The projection 98*b* receives one end of the biasing member 94 to maintain the correct orientation of the biasing member 94 within the recess 90*b* of the housing 90. By changing the amount that the threaded portion 98*a* is screwed into the threaded bore 90*a* of the housing 90, the urging force on the contact member 92 can be easily changed based on the position of the setting member 98 within the threaded bore 90*a* of the housing 90.

Figure 19:
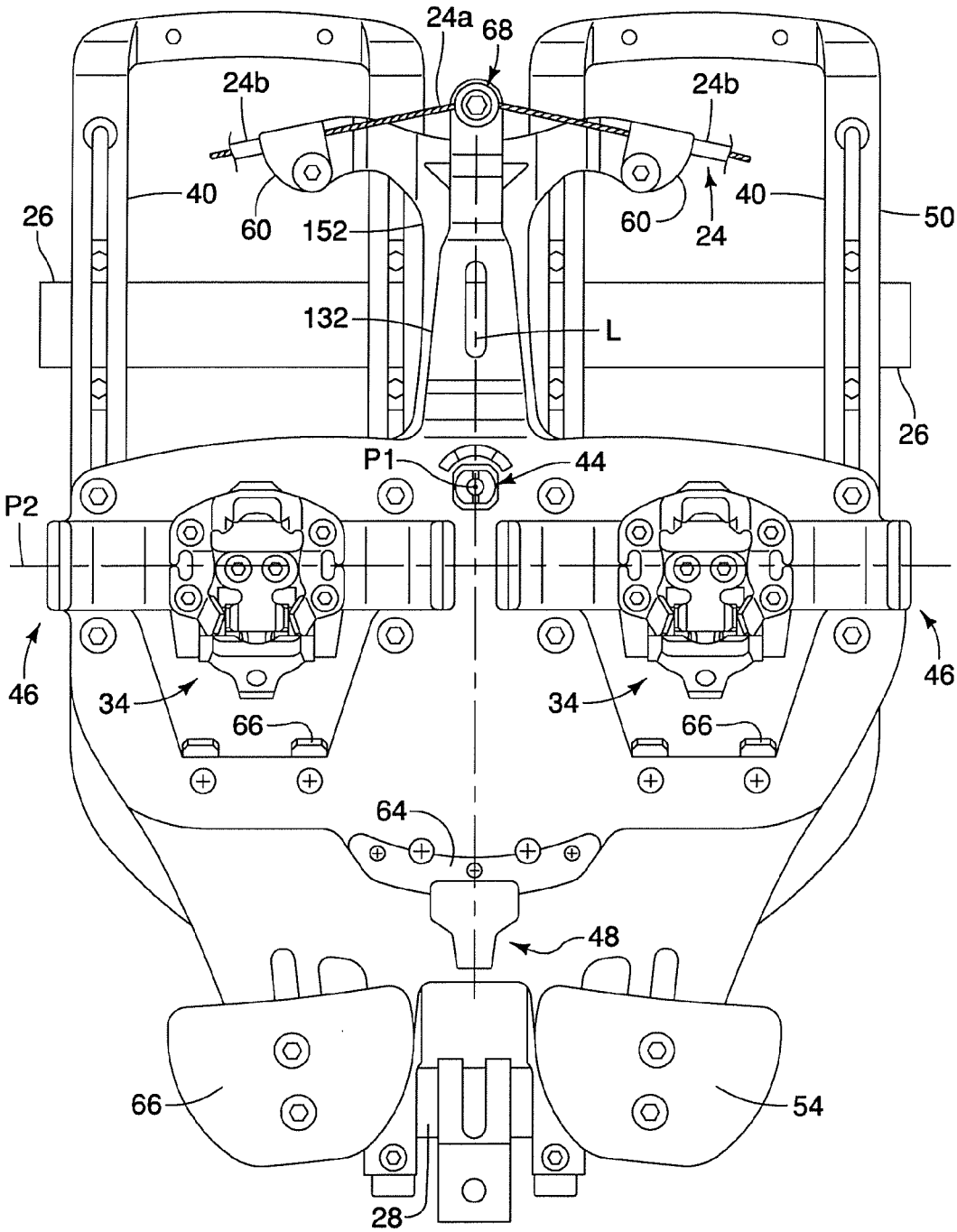
FIG. 19 is a top view of a rowing boat footrest assembly in accordance with a second embodiment.

Referring now to FIG. 19, a rowing boat footrest assembly in accordance with a second embodiment will now be explained. In view of the similarity between the first and second embodiments, the parts of the second embodiment that are identical to the parts of the first embodiment will be given the same reference numerals as the parts of the first embodiment. Moreover, the descriptions of the parts of the second embodiment that are identical to the parts of the first embodiment may be omitted for the sake of brevity.

In this second illustrated embodiment, a modified foot-rudder control member 132 is pivotally supported on a modified support plate 152 about the first pivot axis P1 using the first pivot structure 44 of the first embodiment. Also the positioning structure 48 of the first embodiment is used to selectively retain the foot-rudder control member 132 from pivoting with respect to the support plate 152 on the first pivot axis P1. In this second illustrated embodiment, two of the footrest members 34 are pivotally supported on the foot-rudder control member 132 to pivot or swing about the second pivot axis P2 with respect to the foot-rudder control member 32 by a pair of the second pivot structures 46, respectively. Thus, in this second illustrated embodiment, the foot-rudder control member 132 includes an additional footrest member with a step-in shoe attachment structure, as compared to the first embodiment. In this way, the rower controls the rudder 22 by pivoting both of the footrest members 34 together about the first pivot axis P1.

Figure 20:
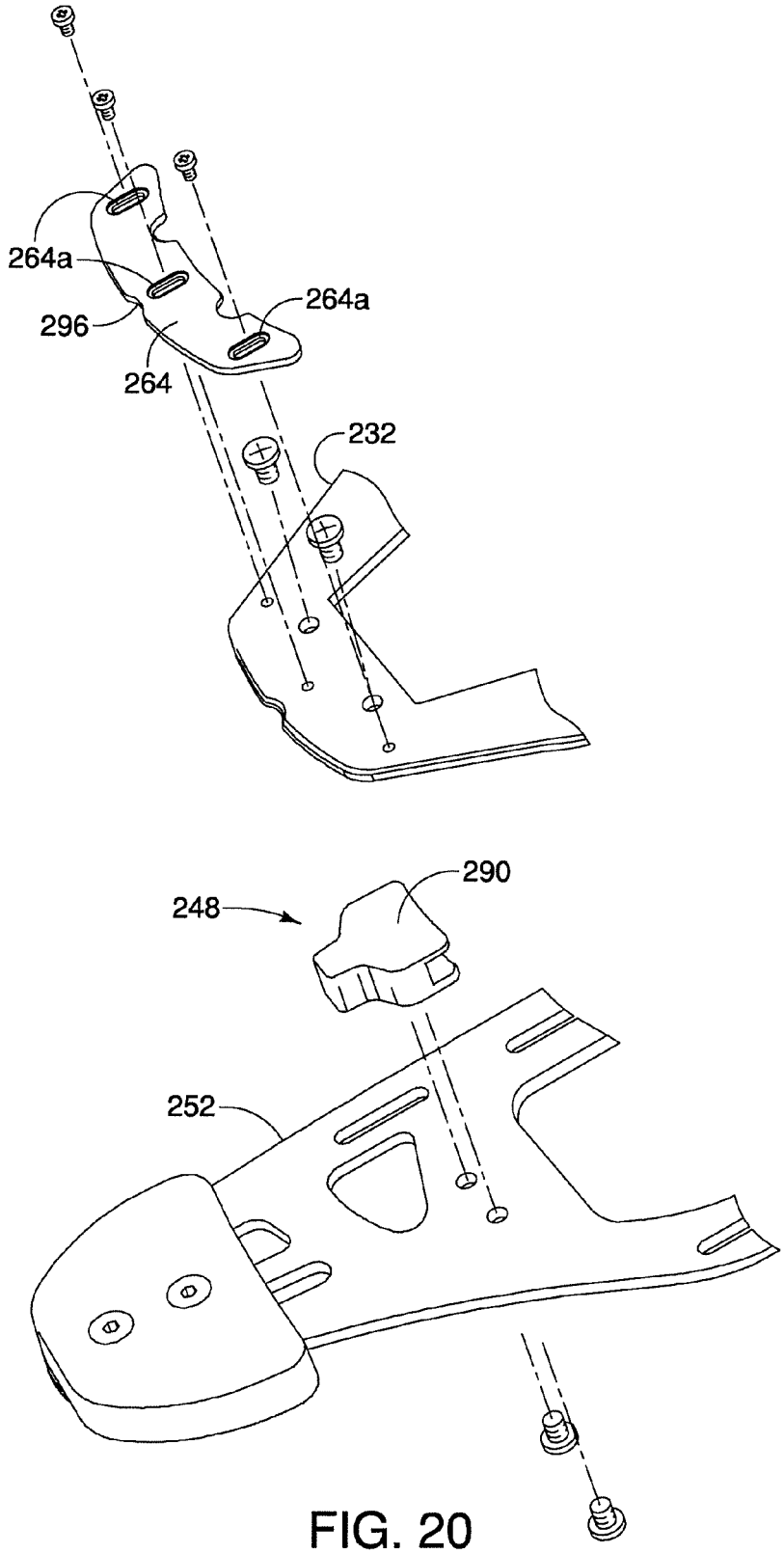
FIG. 20 is an exploded, perspective view of selected parts of a right footrest of a modified rowing boat footrest assembly with a first alternative positioning structure.
Figure 21:
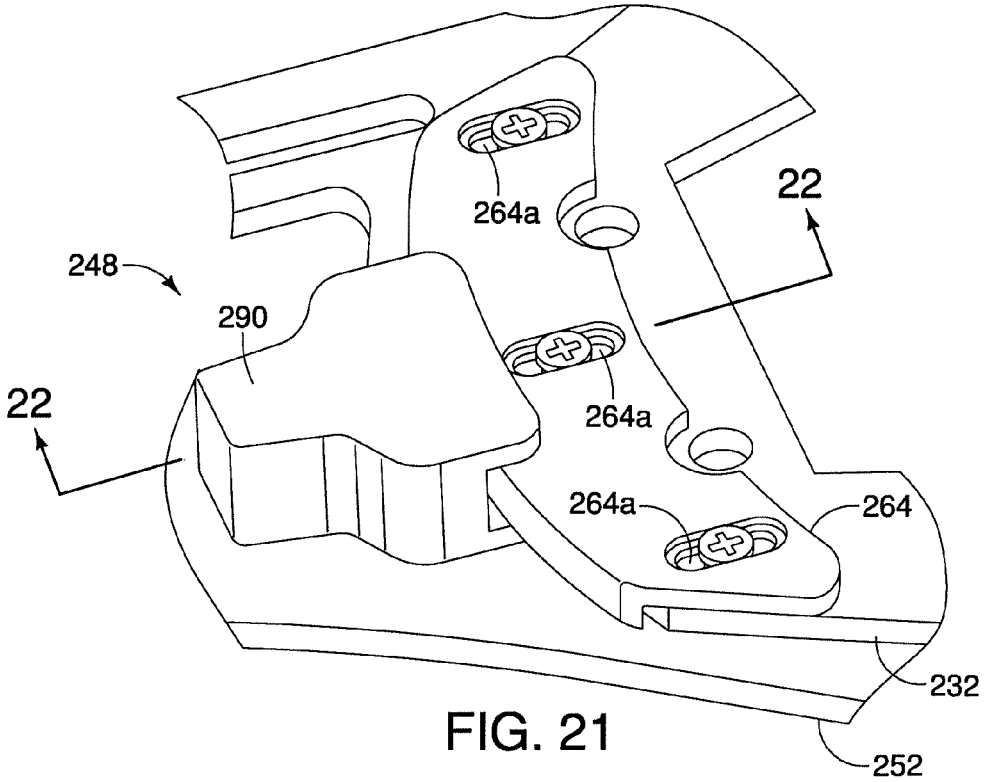
FIG. 21 is a perspective view of the positioning structure illustrated in FIG. 20, with the positioning structure maintaining the foot-rudder control member in the center location for holding the rudder straight with respect to the longitudinal foot axis of the boat.
Figure 22:
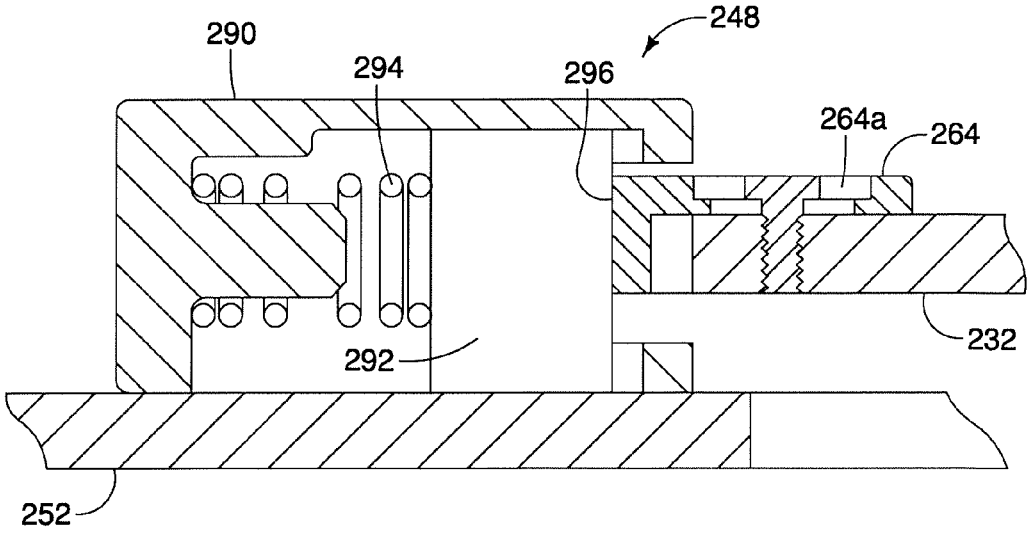
FIG. 22 is a cross sectional view of the positioning structure illustrated in FIGS. 20 and 21 as seen along section line 22-22 of FIG. 21, which corresponds to a plane that is perpendicular to the upper surface of the support plate.

Referring now to FIGS. 20-22, an alternate positioning structure 248 will now be explained. Basically, the positioning structure 248 replaces the positioning structure 48, with only minor changes to the rowing boat footrest assembly 12. In particular, in order to accommodate the positioning structure 248, the foot-rudder control member 32, the support plate 52 and the resin control plate 64 of the rowing boat footrest assembly 12 are replaced with a foot-rudder control member 232, a support plate 252 and a resin control plate 264. All other parts of the rowing boat footrest assembly 12 remain the same. The foot-rudder control member 232 differs from the foot-rudder control member 32 in that the heel end of the foot-rudder control member 232 has been extended in the heel end direction of the foot-rudder control member 232. The support plate 252 differs from the support plate 52 in that the access opening 52*b* has been eliminated and the holes for mounting the positioning structure 248 have been moved in the heel end direction of the support plate 252. The resin control plate 264 differs from the resin control plate 64 in that adjustment slots 264*a* have been added to the resin control plate 264 and the resin control plate 264 has been made larger to accommodate the adjustment slots 264*a*.

The positioning structure 248 mainly includes a housing 290, a contact member 292, a biasing member 294 and a notch or recess 296 in the resin control plate 264. In this illustrated embodiment, the resin control plate 264 constitutes a biasing force adjustment setting member of the positioning structure 248. By changing the position of the resin control plate 264 on the foot-rudder control member 232, the effective biasing force of the biasing member 294 is adjusted. Other than the way in which the biasing force is adjusted, the operation and the function of the positioning structure 248 is the same as the positioning structure 48. Thus, the positioning structure 248 will not be discussed in further detail.

Figure 23:
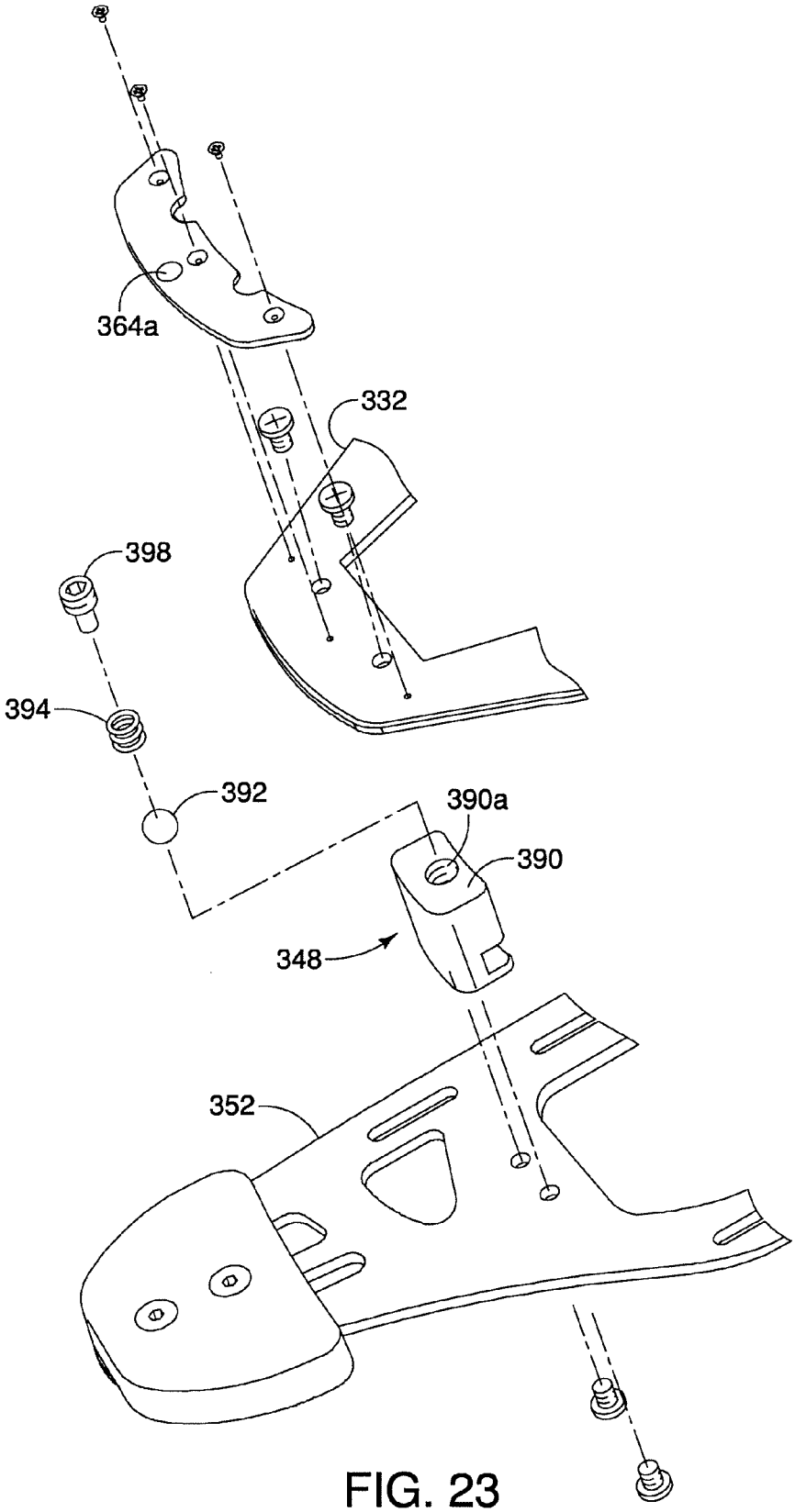
FIG. 23 is an exploded, perspective view of selected parts of a right footrest of a modified rowing boat footrest assembly with a second alternative positioning structure.
Figure 24:
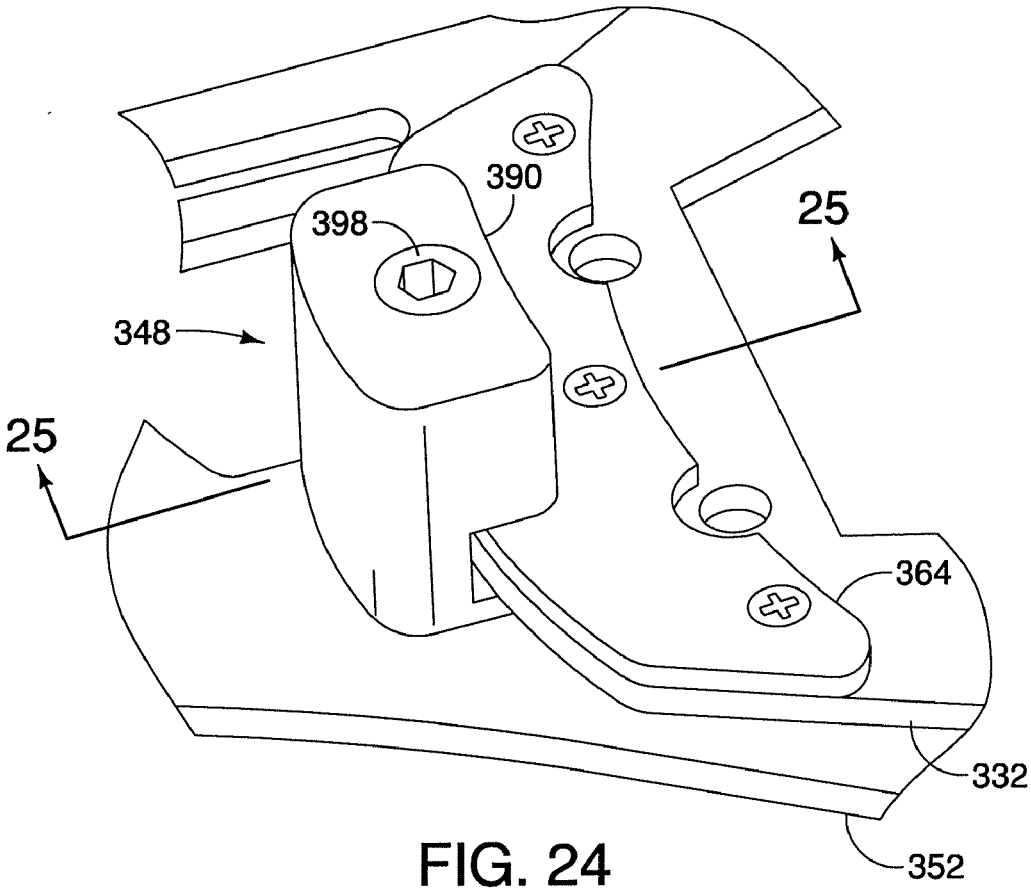
FIG. 24 is a perspective view of the positioning structure illustrated in FIG. 23, with the positioning structure maintaining the foot-rudder control member in the center location for holding the rudder straight with respect to the longitudinal foot axis of the boat.
Figure 25:
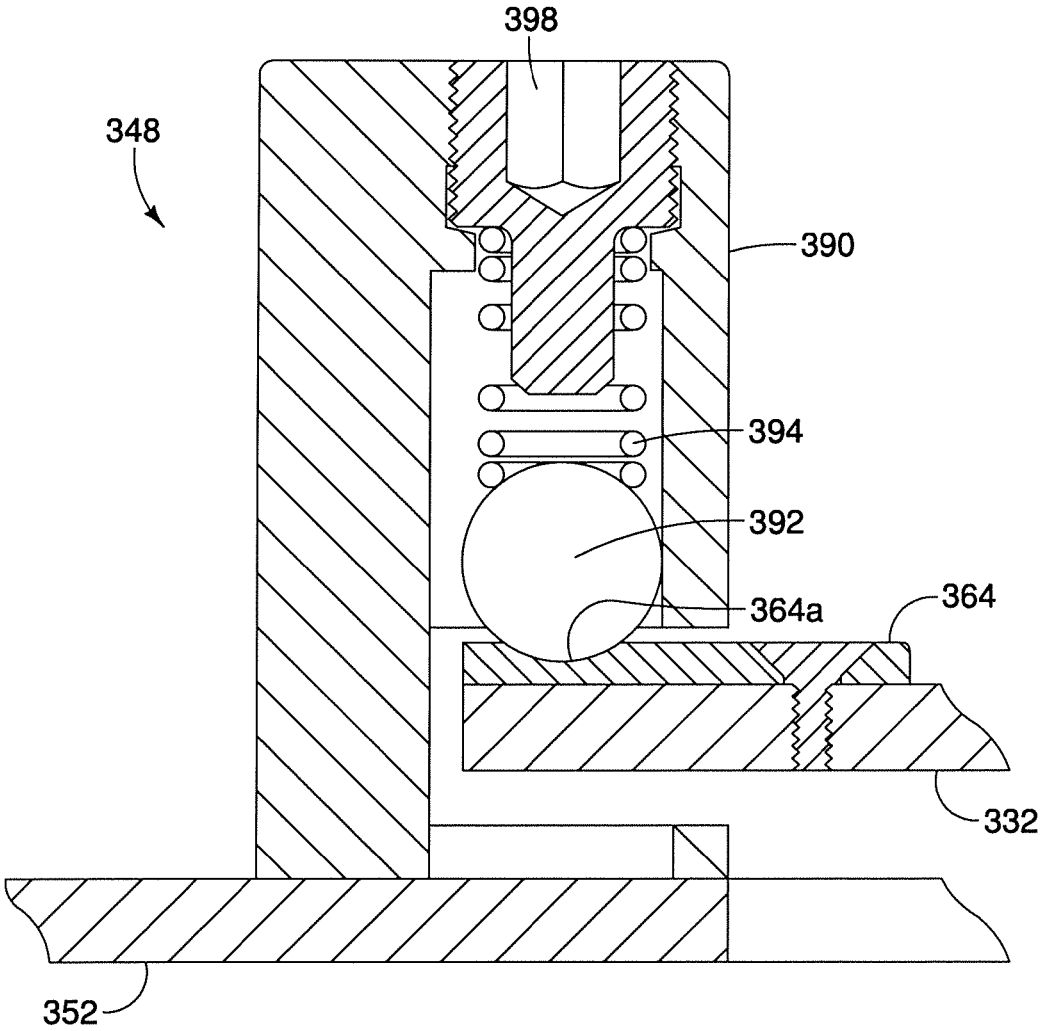
FIG. 25 is a cross sectional view of the positioning structure illustrated in FIGS. 23 and 24 as seen along section line 25-25 of FIG. 24, which corresponds to a plane that is perpendicular to the upper surface of the support plate.

Referring now to FIGS. 23-25, another alternate positioning structure 348 will now be explained. Basically, the positioning structure 348 replaces the positioning structure 48, with only minor changes to the rowing boat footrest assembly 12. In particular, in order to accommodate the positioning structure 348, the foot-rudder control member 32, the support plate 52 and the resin control plate 64 of the rowing boat footrest assembly 12 are replaced with a foot-rudder control member 332, a support plate 352 and a resin control plate 364. All other parts of the rowing boat footrest assembly 12 remain the same. The foot-rudder control member 332 differs from the foot-rudder control member 32 in that the heel end of the foot-rudder control member 332 has been extended in the heel end direction of the foot-rudder control member 332. The support plate 352 differs from the support plate 52 in that the access opening 52*b* has been eliminated. The resin control plate 364 differs from the resin control plate 64 in that a recess or depression 364*a* has been added to the upper surface of the resin control plate 364 and the resin control plate 364 has been made larger to accommodate the depression 364*a*.

In this illustrated embodiment, the depression 364*a* of the resin control plate 364 constitutes part of the positioning structure 348. In addition to the depression 364*a* of the resin control plate 364, the positioning structure 348 mainly includes a housing 390, a contact member 392, a biasing member 394 and a setting member 398. In this illustrated embodiment, the setting member 398 is adjustably arranged to change the urging force of the biasing member 394 on the contact member 392. The setting member 398 is threadedly disposed in the threaded bore 390*a* of the housing 390. By change the position of the setting member 398 within the threaded bore 390*a* by screwing the setting member 398 in or out of the threaded bore 390*a*, the effective biasing force of the biasing member 394 is adjusted. Thus, the setting member 398 constitutes a biasing force adjustment setting member of the positioning structure 348. Other than the way in which the biasing force is adjusted, the operation and the function of the positioning structure 348 is the same as the positioning structure 48. Thus, the positioning structure 348 will not be discussed in further detail.

General Interpretation of Terms

In understanding the scope of the present invention, the term "comprising" and its derivatives, as used herein, are intended to be open ended terms that specify the presence of the stated features, elements, components, groups, integers, and/or steps, but do not exclude the presence of other unstated features, elements, components, groups, integers and/or steps. The foregoing also applies to words having similar meanings such as the terms, "including", "having" and their derivatives. Also, the terms "part," "section," "portion," "member" or "element" when used in the singular can have the dual meaning of a single part or a plurality of parts. As used herein to describe the above embodiment(s), the following directional terms "forward", "rearward", "above", "downward", "vertical", "horizontal", "below" and "transverse" as well as any other similar directional terms refer to those directions of a boat equipped with the rowing boat footrest assembly. Accordingly, these terms, as utilized to describe the rowing boat footrest assembly should be interpreted relative to a boat equipped with the rowing boat footrest assembly as used in the normal rowing position. Finally, terms of degree such as "substantially", "about" and "approximately" as used herein mean a reasonable amount of deviation of the modified term such that the end result is not significantly changed.

While only selected embodiments have been chosen to illustrate the present invention, it will be apparent to those skilled in the art from this disclosure that various changes and modifications can be made herein without departing from the scope of the invention as defined in the appended claims. For example, the size, shape, location or orientation of the various components can be changed as needed and/or desired. Components that are shown directly connected or contacting each other can have intermediate structures disposed between them. The functions of one element can be performed by two, and vice versa. The structures and functions of one embodiment can be adopted in another embodiment. It is not necessary for all advantages to be present in a particular embodiment at the same time. Every feature which is unique from the prior art, alone or in combination with other features, also should be considered a separate description of further inventions by the applicant, including the structural and/or functional concepts embodied by such feature(s). Thus, the foregoing descriptions of the embodiments according to the present invention are provided for illustration only, and not for the purpose of limiting the invention as defined by the appended claims and their equivalents.

What is claimed is:

1. A rowing boat footrest assembly comprising:

a base;

a foot-rudder control member pivotally coupled to the base, the foot-rudder control member including a rudder control attachment, a footrest member supported on the foot-rudder control member, the footrest member including a shoe attachment; and a positioning structure operatively coupled between the base and the foot-rudder control member, the positioning structure including a contact member and a setting member, the contact member being movably provided to the base and movably supported on the base by a housing that is non-movably fixed to the base, the contact member being biased into contact with the foot-rudder control member, the setting member being adjustably arranged to change an urging force on the contact member.

2. A rowing boat footrest assembly comprising:

a base;

a foot-rudder control member pivotally coupled to the base, the foot-rudder control member including a rudder control attachment and a pivotal support plate, a footrest member supported on the foot-rudder control member, the footrest member including a shoe attachment; and a positioning structure operatively coupled between the base and the foot-rudder control member, the positioning structure including a contact member and a setting member, the contact member being movably provided to the base and movably supported on the base by a housing, the contact member being biased into contact with a peripheral edge of the pivotal support plate of the foot-rudder control member, the setting member being adjustably arranged to change an urging force on the contact member.

3. The rowing boat footrest assembly according to claim 2, wherein the pivotal support plate has a recess on the peripheral edge that selectively receives the contact member to maintain the foot-rudder control member in a predetermined angular position with respect to the base unless a force is applied that overrides the urging force on the contact member.

4. The rowing boat footrest assembly according to claim 3, wherein the contact member is located in the recess of the pivotal support plate such that the predetermined angular position of the foot-rudder control member with respect to the base is an intermediate position between two end positions of a prescribed range of pivotal movement of the foot-rudder control member with respect to the base.

5. A rowing boat footrest assembly comprising:

a base;

a foot-rudder control member pivotally coupled to the base, the foot-rudder control member including a rudder control attachment, a footrest member supported on the foot-rudder control member, the footrest member including a shoe attachment; and a positioning structure operatively coupled between the base and the foot-rudder control member, the positioning structure including a contact member and a setting member, the contact member being movably provided to one of the base and the foot-rudder control member, the contact member being biased into contact with the other of the base and the foot-rudder control member, the setting member being adjustably arranged to change an urging force on the contact member, and the setting member being threadedly disposed in a threaded bore of a housing supported on one of the base and the foot-rudder control member such that the urging force on the contact member is changed based on a position of the setting member in the threaded bore of the housing.

6. The rowing boat footrest assembly according to claim 1, wherein at least one of the base and the housing includes at least an access opening that is dimensioned for selectively removing the contact member from the housing through the access opening, the contact member being removable through the access opening with the housing fixed to the base in an installed position.

7. The rowing boat footrest assembly according to claim 1, wherein the housing includes a mounting surface that faces a support surface of the base to which the housing is attached, the mounting surface including a recess that houses the contact member and a biasing member that applies the urging force on the contact member.

8. The rowing boat footrest assembly according to claim 7, wherein the housing further includes a threaded bore that communicates with the recess of the housing, the setting member being threadedly disposed in the threaded bore of the housing such that the urging force on the contact member is changed based on a position of the setting member in the threaded bore of the housing.

9. The rowing boat footrest assembly according to claim 8, wherein at least one of the base and housing includes at least an access opening that is at least partially aligned with the recess of the housing, with the access opening being dimensioned for selectively removing the contact member from the recess of the housing through the access opening.

10. The rowing boat footrest assembly according to claim 5, wherein the contact member is movably provided to the base and is movably supported on the base by a housing that is non-movably fixed to the base, and the contact member is biased into contact with the foot-rudder control member.

11. The rowing boat footrest assembly according to claim 5, wherein at least one of the base and the housing includes at least an access opening that is dimensioned for selectively removing the contact member from the housing through the access opening, the contact member being removable through the access opening with the housing fixed to the base in an installed position.

12. The rowing boat footrest assembly according to claim 5, wherein the housing includes a mounting surface that faces a support surface of the base to which the housing is attached, the mounting surface including a recess that houses the contact member and a biasing member that applies the urging force on the contact member.

13. The rowing boat footrest assembly according to claim 12, wherein the threaded bore of the housing communicates with the recess of the housing.

14. The rowing boat footrest assembly according to claim 13, wherein at least one of the base and housing includes at least an access opening that is at least partially aligned with the recess of the housing, with the access opening being dimensioned for selectively removing the contact member from the recess of the housing through the access opening.

* * * * *